US010066186B2

(12) United States Patent
DeSantis et al.

(10) Patent No.: US 10,066,186 B2
(45) **Date of Patent: *Sep. 4, 2018**

(54) LUBRICATING OIL COMPOSITIONS CONTAINING A HALIDE SEAL COMPATIBILITY ADDITIVE AND A SECOND SEAL COMPATIBILITY ADDITIVE

(71) Applicant: BASF SE, Ludwigshafen (DE)

(72) Inventors: Kevin DeSantis, Upper Nyack, NY (US); Michael Hoey, Maplewood, NJ (US); Al Jung, Carmel, NY (US); Phil Rabbat, Maplewood, NJ (US); David Chasan, Teaneck, NJ (US); Stephen Jones, Pomona, NY (US)

(73) Assignee: BASF SE, Ludwigshafen (DE)

( * ) Notice: Subject to any disclaimer, the term of this patent is extended or adjusted under 35 U.S.C. 154(b) by 119 days.

This patent is subject to a terminal disclaimer.

(21) Appl. No.: 14/662,965

(22) Filed: Mar. 19, 2015

(65) Prior Publication Data

US 2015/0191673 A1 Jul. 9, 2015

Related U.S. Application Data

(63) Continuation-in-part of application No. 14/258,871, filed on Apr. 22, 2014.

(60) Provisional application No. 61/814,698, filed on Apr. 22, 2013.

(51) Int. Cl.

| | |
|---|---|
| ***C10M 141/10*** | (2006.01) |
| ***C10L 1/22*** | (2006.01) |
| ***C10M 141/06*** | (2006.01) |
| ***C10M 141/04*** | (2006.01) |
| ***C10M 141/08*** | (2006.01) |
| ***C10M 141/12*** | (2006.01) |

(52) U.S. Cl.

CPC ..... *C10M 141/06* (2013.01); *C10M 141/04* (2013.01); *C10M 141/08* (2013.01); *C10M 141/12* (2013.01); *C10M 2201/087* (2013.01); *C10M 2207/042* (2013.01); *C10M 2211/022* (2013.01); *C10M 2215/221* (2013.01); *C10M 2219/044* (2013.01); *C10N 2220/031* (2013.01); *C10N 2230/36* (2013.01); *C10N 2270/02* (2013.01)

(58) Field of Classification Search

CPC ..... C10M 131/02; C10M 131/00; C10M 131/04; C10M 2211/00

USPC ..... 508/260, 262

See application file for complete search history.

(56) References Cited

U.S. PATENT DOCUMENTS

| | | | | |
|---|---|---|---|---|
| 2,490,606 | A | 12/1949 | Williams et al. | |
| 3,138,629 | A | 6/1964 | Laughlin et al. | |
| 3,865,743 | A | 2/1975 | Sheratte | |
| 4,153,418 | A | 5/1979 | Haas | |
| 4,289,501 | A | 9/1981 | Medcalf | |
| 4,430,092 | A | 2/1984 | Rosenthal | |
| 4,451,266 | A | 5/1984 | Barclay et al. | |
| 4,551,154 | A | 11/1985 | Malcosky et al. | |
| 4,941,986 | A | 7/1990 | Jolly | |
| 5,174,916 | A | 12/1992 | Osgood | |
| 5,503,760 | A | 4/1996 | Bongardt et al. | |
| 5,759,857 | A | 6/1998 | Goyal et al. | |
| 5,980,593 | A | 11/1999 | Friswell et al. | |
| 6,214,624 | B1 | 4/2001 | Barker et al. | |
| 6,262,126 | B1 * | 7/2001 | Meinert | A61K 9/0014 514/746 |
| 6,312,958 | B1 | 11/2001 | Meyer et al. | |
| 6,410,492 | B1 | 6/2002 | Shimomura et al. | |
| 7,932,218 | B2 | 4/2011 | Chasan et al. | |
| 8,158,432 | B2 | 4/2012 | Grof et al. | |
| 8,247,361 | B2 | 8/2012 | Shimura et al. | |
| 2002/0147116 | A1 | 10/2002 | Carrick et al. | |
| 2004/0029747 | A1 | 2/2004 | Emert et al. | |
| 2004/0248307 | A1 * | 12/2004 | Grof | G01N 33/2882 436/56 |
| 2007/0157510 | A1 * | 7/2007 | Grof | C10L 10/00 44/456 |
| 2007/0203031 | A1 | 8/2007 | Bardasz et al. | |
| 2008/0051306 | A1 * | 2/2008 | Chasan | C10M 133/40 508/267 |
| 2008/0111100 | A1 | 5/2008 | Thomas et al. | |
| 2011/0041797 | A1 | 2/2011 | Strickland et al. | |

(Continued)

FOREIGN PATENT DOCUMENTS

| | | |
|---|---|---|
| EP | 0456925 | 5/1990 |
| EP | 0 449 406 A1 | 10/1991 |

(Continued)

OTHER PUBLICATIONS

International Search Report for Application No. PCT/US2014/034983 dated Sep. 1, 2014, 4 pages.

International Search Report for Application No. PCT/US2014/035016 dated Sep. 1, 2014, 4 pages.

International Search Report for Application No. PCT/US2014/035001 dated Sep. 4, 2014, 3 pages.

(Continued)

*Primary Examiner* — Prem C Singh

*Assistant Examiner* — Frank C Campanell

(74) *Attorney, Agent, or Firm* — Lowenstein Sandler LLP

(57) ABSTRACT

This disclosure is directed to an additive package for a lubricant composition that provides improved fluoropolymer compatibility. The additive package comprises a halide seal compatibility additive and a second seal compatibility additive. The disclosure is also directed to a lubricant composition comprising a base oil, a halide seal compatibility additive, and a second seal compatibility additive. The halide seal compatibility and the second seal compatibility additive improves the fluoropolymer seal compatibility of the resultant lubricant composition.

28 Claims, No Drawings

(56) References Cited

U.S. PATENT DOCUMENTS

| | | | |
|---|---|---|---|
| 2011/0152145 | A1 | 6/2011 | Kamano et al. |
| 2012/0149618 | A1 | 6/2012 | Yamaguchi et al. |
| 2013/0005624 | A1 | 1/2013 | Kamano et al. |
| 2014/0051621 | A1 | 2/2014 | DeSantis et al. |
| 2014/0315767 | A1 | 10/2014 | DeSantis et al. |
| 2014/0315768 | A1 | 10/2014 | DeSantis et al. |

FOREIGN PATENT DOCUMENTS

| | | | |
|---|---|---|---|
| EP | 0 538 478 | A1 | 4/1993 |
| EP | 0 612 839 | A1 | 8/1994 |
| EP | 0 714 973 | A1 | 6/1996 |
| EP | 0 733 696 | A1 | 9/1996 |
| EP | 0 913 457 | A2 | 5/1999 |
| EP | 0 931 828 | A2 | 7/1999 |
| EP | 2 138 559 | A1 | 12/2009 |
| EP | 2 236 589 | A1 | 10/2010 |
| GB | 718567 | | 11/1954 |
| GB | 854964 | | 11/1960 |
| GB | 1 209 982 | | 10/1970 |
| JP | S4917803 | | 2/1974 |
| WO | WO 00/26327 | A1 | 5/2000 |
| WO | WO 02098199 | A2 | 12/2002 |
| WO | WO2008015116 | | 2/2008 |
| WO | WO2012082285 | | 6/2012 |
| WO | WO 2014028609 | A1 | 2/2014 |
| WO | WO 2014028629 | A1 | 2/2014 |

OTHER PUBLICATIONS

Communication Pursuant to Article 94(3) EPC dated Mar. 14, 2018, 4 pages.

* cited by examiner

LUBRICATING OIL COMPOSITIONS CONTAINING A HALIDE SEAL COMPATIBILITY ADDITIVE AND A SECOND SEAL COMPATIBILITY ADDITIVE

CROSS-REFERENCE TO RELATED APPLICATIONS

This application is a continuation-in-part application that claims priority to U.S. patent application Ser. No. 14/258,871, which claims priority to U.S. Provisional Patent Application No. 61/814,698, filed on Apr. 22, 2013; both of which are hereby incorporated by reference.

FIELD OF THE INVENTION

The present invention generally relates to a lubricant composition that includes a base oil, a halide seal compatibility additive and a second seal compatibility additive. The invention also relates to an additive package for a lubricant composition.

BACKGROUND OF THE INVENTION

It is known and customary to add stabilizers to lubricant compositions based on mineral or synthetic oils in order to improve their performance characteristics. Some conventional amine compounds are effective stabilizers for lubricants. These conventional amine compounds may help neutralize acids formed during the combustion process. However, these conventional amine compounds are generally not employed in combustion engines due to their detrimental effects on fluoropolymer seals.

It is an object of the present invention to provide new additive packages that improve the fluoropolymer seal compatibility of lubricant compositions.

SUMMARY OF THE INVENTION

The present invention provides an additive package for a lubricant composition that improves fluoropolymer compatibility of the lubricant composition. The additive package comprises a halide seal compatibility additive and a second seal compatibility additive. The second seal compatibility additive is different from the halide seal compatibility additive. The weight of the second seal compatibility additive in the additive package is greater than or equal to the weight of the halide seal compatibility additive in the additive package.

The present invention also provides a lubricant composition having improved fluoropolymer compatibility. The lubricant composition comprises a base oil, the halide seal compatibility additive, and the second seal compatibility additive. The second seal compatibility additive is different from the halide seal compatibility additive. The weight of the second seal compatibility additive in the lubricant composition is greater than or equal to the weight of the halide seal compatibility additive in the lubricant composition.

The present invention also provides a method of lubricating a system comprising a fluoropolymer seal. The method includes providing a lubricant composition comprising the base oil, the halide seal compatibility additive, the second seal compatibility additive, and contacting the fluoropolymer seal with the lubricant composition. The second seal compatibility additive is different from the halide seal compatibility additive. The weight of the second seal compatibility additive in the lubricant composition is greater than or equal to the weight of the halide seal compatibility additive in the lubricant composition.

Lubricant compositions comprising the halide seal compatibility additive and the second seal compatibility additive demonstrate improved compatibility with fluoropolymer seals as demonstrated by CEC L-39-T96.

DETAILED DESCRIPTION OF THE INVENTION

An additive package for a lubricant composition comprises a halide seal compatibility additive and a second seal compatibility additive. The additive package may be added to conventional lubricant compositions. Both the additive package and the resultant lubricant composition (upon addition of the additive package) are contemplated and described collectively in this disclosure.

The lubricant composition includes the halide seal compatibility additive and a second seal compatibility additive. Both the halide seal compatibility additive and the second seal compatibility additive may comprise a variety of different forms, so long as lubricant compositions that include the halide seal compatibility additive and the second seal compatibility additive demonstrate improved compatibility with fluoropolymer seals when measured in accordance with CEC L-39-T96. It is believed that the first seal compatibility additive and the second seal compatibility additive interact, but do not react, so as to minimize the negative interaction between the lubricant composition and a fluoropolymer seal as the lubricant composition contacts the fluoropolymer seal.

In certain embodiments, the halide seal compatibility additive may be a halogen compound. The halogen compound minimally includes one or more halogen atoms. However, the halogen compound can take various forms. For example, the halogen compound may comprise a hydrocarbon backbone. More specifically, the halogen compound may comprise an alkyl halide compound, or may comprise a quaternary amine compound having one or more halogen atoms bonded thereto. Alternatively, the halogen compound may be an elemental halogen, such as $Cl_2$, $Br_2$, $I_2$ or $F_2$.

In one or more embodiments, the halogen compound comprises the hydrocarbon backbone and at least one halogen atom bonded to a carbon atom in the hydrocarbon backbone. The halogen compound may be straight or branched. The hydrocarbon backbone may be cyclic or acyclic. The hydrocarbon backbone may also be straight. The hydrocarbon backbone may include from 1 to 30, 2 to 25, 2 to 20, 2 to 15, 9 to 15, or 9 to 12, carbon atoms.

The halogen compound may comprise one or more pendant groups selected from the group of alcohol groups, alkoxy groups, alkenyl groups, alkynyl groups, amine groups, aryl groups, alkylaryl, arylalkyl, heteroaryl groups, alkyl groups, cycloalkyl groups, cycloalkenyl, amide groups, ether groups, ester groups, and combinations thereof, each independently having from 1 to 30, 1 to 20, 1 to 15, or 3 to 12, carbon atoms. Each of these pendant groups may be bonded to a carbon atom positioned in hydrocarbon backbone of the halogen compound. By "unsubstituted," it is intended that the designated hydrocarbyl group or hydrocarbon group is free from substituent functional groups, such as alkoxy, amide, amine, keto, hydroxyl, carboxyl, oxide, thio, and/or thiol groups, and that the designated hydrocarbyl group or hydrocarbon group is free from heteroatoms and/or heterogroups.

In one embodiment, the halogen compound is cyclic, meaning that the halogen compound includes one or more pendant cyclic groups, that the hydrocarbon backbone, if present, is cyclic, or both. In another embodiment, the halogen compound is acyclic, meaning that the hydrocarbon backbone, if present, is acyclic and the halogen compound is free from pendant cyclic groups.

The hydrocarbon backbone, if present, may include functional groups other than the halogen atom, such as hydroxyl, carboxyl, carbonyl, epoxy, oxide, thio, and thiol groups. These functional groups may be bonded to the carbon atoms which are positioned in the hydrocarbon backbone of the halogen compound. The hydrocarbon backbone, if present, may also comprise one or more heteroatoms, such as oxygen, sulfur, and nitrogen heteroatoms; or one or more heterogroups, such as pyridyl, furyl, thienyl, and imidazolyl.

Alternatively, if present, the hydrocarbon backbone may include no pendant or functional groups bonded to the carbon atoms in the hydrocarbon backbone other than the halogen atom. In addition, or as an alternative, the hydrocarbon backbone may be free from heteroatoms and heterogroups. The hydrocarbon backbone may be saturated or unsaturated.

The halogen compound may include fluorine atoms, bromine atoms, iodine atoms, and combinations thereof. Each of these halogen atoms may be bonded to a carbon atom in the hydrocarbon backbone, a carbon atom in one of the pendant groups of the hydrocarbon backbone, or both. The halogen compound may comprise 1, 2, 3, 4, 5, 6, 7, 8, 9 or 10 or more halogen atoms per molecule. It is also contemplated that one or more different halogen atoms may be present in the same molecule of the halogen compound.

In embodiments, the halogen compound comprises the alkyl halide compound and may have a general formula (I):

$$C_nH_{2n+2-m}X_m \quad (I)$$

In general formula (I), $n \geq 1$, $1 \leq m \leq (2n+2)$, and X is a halogen atom. X may be selected from the group including fluorine, bromine, iodine, and combinations thereof. In some embodiments, n may range from 1 to 30, 2 to 25, 2 to 20, 2 to 15, 9 to 15, or 9 to 12; and m may have a value of 1, 2, 3, 4, 5, 6, or more. The alkyl halide compound may be primary, secondary, or tertiary. The alkyl halide compound may be a mono-halide, di-halide, tri-halide, or tetrahalide in some embodiments. It is also contemplated that one or more different halogen atoms may be present in the same alkyl halide compound.

The quaternary halogen compound may be understood as a quaternary amine salt that includes one or more halogen atoms bonded thereto. The halogen atoms may be bonded along the body of the quaternary amine salt or may be bonded to the quaternary amine salt as a halide counter-ion. The quaternary amine compound may include 1, 2, 3, 4, 5, or more nitrogen atoms. The quaternary amine compound may also include 1, 2, 3, 4, 5, or more halogen atoms. It is also contemplated that one or more different halogen atoms may be present in the same quaternary amine compound. The quaternary amine compound may include a variety of different pendent groups, such as alkyl, aryl, alkenyl, alkynyl, cycloalkyl, arylalkyl, or heteroaryl groups, each having from 1 to 30, 1 to 20, 1 to 15, or 3 to 12, carbon atoms, and may be further substituted by one or more amine, imine, hydroxyl, halogen, and/or carboxyl groups. The quaternary amine compound may be cyclic or acyclic.

The halogen compound may have a weight average molecular weight ranging from 30 to 1500, 50 to 1000, 100 to 500, 150 to 500, 200 to 500, or 250 to 500.

The halogen compound may have a boiling point ranging from 50 to 650, 100 to 450, 135 to 450, 140 to 450, 145 to 450, 150 to 450, 155 to 450, or 200 to 400, ° C., at 1 atmosphere. Alternatively, the halogen compound may have a boiling point of at least 100, at least 110, at least 120, at least 130, at least 140, at least 150, or at least 160, ° C., at 1 atmosphere, and less than 450, less than 400, less than 350, less than less than 300, or less than 250, ° C., at 1 atmosphere.

The halogen compound may also be characterized as having a flash point ranging from 10 to 300, 25 to 250, 50 to 250, 75 to 250, or 85 to 200, ° C. Alternatively, the halogen compound may have a flash point of at least 10, at least 15, at least 20, at least 25, at least 30, at least 35, at least 40, at least 45, at least 50, at least 55, at least 60, at least 65, at least 70, at least 75, at least 80, or at least 85, ° C., and a flash point less than 250, less than 225, less than 200, less than 175, less than 150, or less than 125, ° C.

In certain embodiments, the halogen compound is a liquid at a temperature of 25, 30, 35, 40, 45, 50, 55, 60, 65, 70, 75, 80, 85, 90, 95 or 100, ° C., and 1 atmosphere The halogen compound may be synthesized in a variety of ways. For example, the halogen compound can be prepared by reacting an alkene with a halogen halide, such as hydrogen chloride or hydrogen bromide to yield the corresponding monohalogenated alkene. Alternatively, the halogen compound may be prepared by reacting an alcohol with a hydrogen halide. Alternatively still, the halogen compound may be prepared by reacting an alkyl alcohol with carbon tetra bromide, sodium bromide, and a ruthenium catalyst, all in a dimethylformamide solvent. The carbon tetrabromide may be replaced with other halogen compounds if halogens other than bromide are desired.

Exemplary halogen compounds include tetrabromoethane; ethyliodide; ethylbromide; 1,2-dibromoethane; trifluoro-1,2,2-dibromoethane; 1-fluorooctane; tribromopropane; dibromo cyclohexane; dibromoethane; n-propylbromide; 1-bromo, 4-fluoro cyclohexane; butylbromide; octylbromide; 1-iodododecane; 1-bromododecane; 1,4-di iodobutane; 1,4-dibromobutane; tetrafluoroethane; 3-iodo-1-propanol; 1-bromohexane; 1-iodohexane; 1-bromopropane; and 1-iodopropane.

Conventional uses of the halogen compound involve forming a reaction product of the halogen compound. In such conventional uses, more than 50 wt. % of the halogen compound is typically reacted based on the total weight of the halogen compound before reaction. In certain embodiments, at least 50, at least 60, at least 70, at least 80 or, at least 90, wt. %, of the halogen compound remains unreacted in the additive package and/or lubricant composition based on the total weight of halogen compound utilized to form the additive package and/or the lubricant composition prior to any reaction in the additive package or the lubricant composition. Alternatively, at least 95, at least 96, at least 97, at least 98, or at least 99, wt. %, of the halogen compound remains unreacted in the additive package and/or the lubricant composition based on the total weight of the halogen compound prior to any reaction in the additive package or the lubricant composition.

The term "unreacted" refers to the fact that the unreacted amount of the halogen compound does not react with any components in the additive package or lubricant composition. Accordingly, the unreacted portion of the halogen compound remains in its virgin state when present in the additive package or the lubricant composition before the lubricant composition has been used in an end-use application, such as an internal combustion engine.

The phrase "prior to any reaction" refers to the basis of the amount of the halogen compound in the additive package or lubricant composition. This phrase does not require that the halogen compound reacts with other components in the additive package or the lubricant composition, i.e., 100 wt. % of the halogen compound may remain unreacted in the additive package and/or the lubricant composition based on the total weight of the halogen compound prior to any reaction in the additive package and/or the lubricant composition.

Alternatively, the percentage of the halogen compound that remains unreacted is determined after all of the components which are present in the additive package or lubricant composition reach equilibrium with one another. The time period necessary to reach equilibrium in the additive package or lubricant composition may vary widely. For example, the amount of time necessary to reach equilibrium may range from a single minute to many days, or even weeks. In certain embodiments, the percentage of the halogen compound that remains unreacted in the additive package or lubricant composition is determined after 1 minute, 1 hour, 5 hours, 12 hours, 1 day, 2 days, 3 days, 1 week, 1 month, 6 months, or 1 year.

In one aspect, the halide seal compatibility additive is an iodide seal compatibility additive. The iodide seal compatibility additive includes at least iodine atom. Beyond that, the iodide seal compatibility additive may take many forms. For example, the iodide seal compatibility additive may include a hydrocarbon backbone. Furthermore, the iodide seal compatibility additive may be an alkyl iodide compound, or may be a quaternary amine compound having at least one iodine atom bonded thereto. Alternatively still, the iodide seal compatibility additive may be elemental iodine ($I_2$).

In one or more embodiments, the iodide seal compatibility additive includes a hydrocarbon backbone and at least one iodine atom bonded to a carbon atom in the hydrocarbon backbone. In certain embodiments, the iodide seal compatibility additive includes the hydrocarbon backbone and at least one iodine atom. The iodide seal compatibility additive may be straight or branched. The hydrocarbon backbone may be cyclic or acyclic. The hydrocarbon backbone may include from 1 to 30, 2 to 25, 2 to 20, 2 to 15, 9 to 15, or 9 to 12, carbon atoms. As used herein, the term "acyclic" is intended to refer to hydrocarbon backbones which are free from any cyclic structures and to exclude aromatic structures.

In some aspects, the iodide seal compatibility additive may include at least one pendant group. In some embodiments, the at least one pendant group is selected from alcohol groups, alkoxy groups, alkenyl groups, alkynyl groups, amine groups, aryl groups, alkylary groups, arylalkyl groups, heteroaryl groups, alkyl groups, cycloalkyl groups, cycloalkenyl, amide groups, ether groups, ester groups, and combinations thereof, each having from 1 to 30, 1 to 20, 1 to 15, or 3 to 12, carbon atoms. Each of these pendant groups may be bonded to a carbon atom positioned in the hydrocarbon backbone of the iodide seal compatibility additive.

In one embodiment, the iodide seal compatibility additive is cyclic, meaning that the iodide seal compatibility additive includes the hydrocarbon backbone and that the hydrocarbon backbone includes at least one pendant cyclic group, that the hydrocarbon backbone is cyclic, or both. In another embodiment, the iodide seal compatibility additive is acyclic, meaning that the hydrocarbon backbone is acyclic and that the iodide seal compatibility additive is free from pendant cyclic groups. Alternatively, the hydrocarbon backbone of the iodide seal compatibility additive may be free of pendant and/or functional groups bonded to the carbon atoms in the hydrocarbon backbone other than the iodine atom.

The hydrocarbon backbone of the iodide seal compatibility additive may include functional groups, such as hydroxyl, carboxyl, carbonyl, epoxy, oxide, thio, and thiol groups. One or more of these functional groups may be bonded to hydrocarbon backbone of the iodide seal compatibility additive. The hydrocarbon backbone of the iodide seal compatibility additive may also include at least one heteroatom, such as oxygen, sulfur, and nitrogen heteroatoms; or at least one heterogroup, such as pyridyl, furyl, thienyl, and imidazolyl. In addition, or as an alternative, the hydrocarbon backbone may be free from heteroatoms and heterogroups. For example, the hydrocarbon backbone may be free from oxygen hetero atoms. The hydrocarbon backbone may be saturated or unsaturated.

The iodide seal compatibility additive may additionally include fluorine atoms, chlorine atoms, bromine atoms, and combinations thereof. Each of these halogen atoms may be bonded to a carbon atom in the hydrocarbon backbone of the iodide seal compatibility additive or a carbon atom in one of the pendant groups of the hydrocarbon backbone of the iodide seal compatibility additive. The iodide seal compatibility additive may include 1, 2, 3, 4, 5, 6, 7, 8, 9, 10, or more halogen atoms per molecule. It is also contemplated that two or more different, or that two or more of the same, halogen atoms may be present in the same iodide seal compatibility additive. For example, the iodide seal compatibility additive may include at least one iodine atom and at least one bromine atom.

As described above, the iodide seal compatibility additive may be an alkyl iodide compound. The alkyl iodide compound may have a general formula:

$$C_nH_{2n+2+m}I_m \quad \text{(II)}.$$

In formula (II), $n \geq 1$, and $1 \leq m \leq (2n+2)$. In some embodiments, n may range from 1 to 30, 2 to 25, 2 to 20, 2 to 15, 9 to 15, or 9 to 12; and m may have a value of 1, 2, 3, 4, 5, 6, or more. The alkyl iodide compound may be primary, secondary, or tertiary. It is also contemplated that two or more different, or two or more of the same, halogen atoms may be present in the same alkyl iodide compound. For example, the iodide seal compatibility additive may include 1,4 diiodobutane or 1-iodo-4-bromobutane.

The quaternary halogen compound may be understood as a quaternary amine salt that includes at least one iodine atom bonded thereto. The iodine atom may be bonded along the body of the quaternary amine salt or may be bonded to the quaternary amine salt as a iodide counter-ion. The quaternary amine compound may include 1, 2, 3, 4, 5, or more nitrogen atoms. The quaternary amine compound may also include 1, 2, 3, 4, 5, or more iodine atoms. The quaternary amine compound may include a variety of different pendent groups, such as alkyl, aryl, alkenyl, alkynyl, cycloalkyl, arylalkyl, or heteroaryl groups, each having from 1 to 30, 1 to 20, 1 to 15, or 3 to 12, carbon atoms, and may be further substituted by at least one amine, imine, hydroxyl, halogen, and/or carboxyl group. The quaternary amine compound may be cyclic or acyclic.

Exemplary iodide seal compatibility additives include:

1-iodododecane:

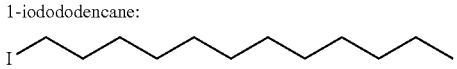

-continued

Ethyliodide:

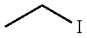

1-iodopropane:

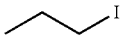

1-iodohexane:

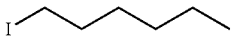

3-iodo-1-propanol:

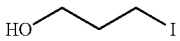

1,4-diiodobutane:

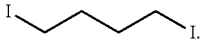

The iodide seal compatibility additive may have a weight average molecular weight ranging from 50 to 1500, 50 to 1000, 100 to 500, 150 to 500, 200 to 500, or 250 to 500.

The iodide seal compatibility additive may have a boiling point ranging from 50 to 650, 100 to 450, 135 to 450, 140 to 450, 145 to 450, 150 to 450, 155 to 450, or 200 to 400, ° C., at 1 atmosphere. Alternatively, the iodide seal compatibility additive may have a boiling point of at least 100, at least 110, at least 120, at least 130, at least 140, at least 150, or at least 160, ° C., at 1 atmosphere, and less than 450, less than 400, less than 350, less than less than 300, or less than 250, ° C., at 1 atmosphere.

The iodide seal compatibility additive may also be characterized as having a flash point ranging from 10 to 300, 25 to 250, 50 to 250, 75 to 250, or 85 to 200, ° C. Alternatively, the iodide seal compatibility additive may have a flash point of at least 10, at least 15, at least 20, at least 25, at least 30, at least 35, at least 40, at least 45, at least 50, at least 55, at least 60, at least 65, at least 70, at least 75, at least 80, or at least 85, ° C., and a flash point less than 250, less than 225, less than 200, less than 175, less than 150, or less than 125, ° C.

In certain embodiments, the iodide seal compatibility additive is a liquid at a temperature of 25, 30, 35, 40, 45, 50, 55, 60, 65, 70, 75, 80, 85, 90, 95 or 100, ° C., and 1 atmosphere.

The iodide seal compatibility additive may be synthesized in a variety of ways. For example, the iodide seal compatibility additive can be prepared by reacting an alkene with hydrogen iodide to yield the corresponding monohalogenated alkane. Alternatively, the iodide seal compatibility additive may be prepared by reacting an alcohol with a hydrogen iodide.

In the context of the additive package, the halide seal compatibility additive, such as the iodide seal compatibility additive, can be present in an amount ranging from 0.1 to 99, 5 to 50, or 10 to 40, wt. %, based on the total weight of the additive package. In the context of a lubricant composition, the halide seal compatibility additive, such as the iodide seal compatibility additive, can be present in an amount ranging from 0.01 to 10, 0.05 to 5, 0.01 to 3, 0.01 to 2, 0.01 to 1.5, 0.01 to 1, 0.01 to 0.75, 0.01 to 0.5, 0.01 to 0.25, or 0.01 to 0.1, wt. %, based on the total weight of the lubricant composition.

The additive package and/or lubricant composition includes the second seal compatibility additive in combination with the halide seal compatibility additive. Furthermore, in certain embodiments, the second seal compatibility additive is free from iodine atoms.

Beyond this constraint, the second seal compatibility additive may have a variety of different chemical formulas. For example, the second seal compatibility additive may be a halogen compound (such as the halogen compound described above), an epoxide compound, a boroxine compound, a sulfonate ester, or a combination thereof. Exemplary types of the second seal compatibility additive will be described in turn below. The second seal compatibility additive may also be a halogen compound as described above, so long as the second seal compatibility additive is different from the halide seal compatibility additive.

However, it should be appreciated that other types of seal compatibility additives may be included other than those seal compatibility additives explicitly described herein.

The weight of the second seal compatibility additive in the lubricant composition (or additive package) is greater than or equal to the weight of the halide seal compatibility additive in the lubricant composition (or additive package). The weight of the second seal compatibility additive in the lubricant composition (or additive package) is at least 10, 25, 50, 75, 100, 125, 150, 200, 300, 400, or 500, %, greater than the weight of the halide seal compatibility additive in the lubricant composition (or additive package).

In the context of the additive package, the second seal compatibility additive can be present in an amount ranging from 0.1 to 99, 5 to 50, or 10 to 40, wt. %, based on the total weight of the additive package. In the context of a lubricant composition, the second seal compatibility additive can be present in an amount ranging from 0.01 to 10, 0.05 to 5, 0.01 to 3, 0.01 to 2, 0.01 to 1.5, 0.01 to 1, 0.01 to 0.75, 0.01 to 0.5, 0.01 to 0.25, or 0.01 to 0.1, wt. %, based on the total weight of the lubricant composition.

In another embodiment, the second seal compatibility additive is an epoxide compound. In certain embodiments, the epoxide compound may be represented by general formula (III):

(III)

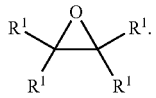

In general formula (III), each $R^1$ is independently a hydrogen atom or a hydrocarbyl group. Multiple groups designated by $R^1$ may be bonded together to form a cyclic structure.

The term "cyclic" is intended to refer to compounds that include any molecules having at least three atoms joined together to form a ring. In some embodiments, the term "cyclic" does not include aromatic compounds.

The epoxide compound may include one or more oxirane ring. The oxirane ring may be a terminal oxirane ring or an internal oxirane ring. The term "terminal oxirane ring" means that one of the carbon atoms which form the oxirane ring must contain two hydrogen atoms, or that two carbons which form the oxirane ring also form part of a cyclic ring. The term "internal oxirane ring" means that neither of the carbon atoms which form the oxirane ring is bonded to more than one hydrogen atom. The epoxide compound may be free from internal oxirane rings, or may include fewer than 4, 3, 2, or 1, internal oxirane rings. Alternatively, the epoxide compound may include 1, 2, 3, 4, or more internal oxirane rings. Alternatively still, the epoxide compound may include at least 1, at least 2, at least 3, at least 4 terminal oxirane rings. In certain embodiments, at least one, or at least two, oxirane rings may be terminal and may be cyclic, i.e., the carbons of the oxirane rings are part of a cyclic ring.

Each hydrocarbyl group designated by $R^1$ may independently be substituted or unsubstituted, straight or branched, alkyl, alkenyl, cycloalkyl, cycloalkenyl, aryl, alkylaryl, arylalkyl group, or combinations thereof. Each hydrocarbyl group designated by $R^1$ may independently include from 1 to 100, 1 to 50, 1 to 40, 1 to 30, 1 to 20, 1 to 15, 1 to 10, 1 to 6, or 1 to 4, carbon atoms. Alternatively, each hydrocarbyl group designated by $R^1$ may independently include less than 20, less than 15, less than 12, or less than 10, carbon atoms.

Alternatively, each hydrocarbyl group designated by $R^1$ may be independently substituted, and include one or more heteroatoms, such as oxygen, nitrogen, sulfur, chlorine, fluorine, bromine, or iodine, and/or one or more heterogroups, such as pyridyl, furyl, thienyl, and imidazolyl. Alternatively, or in addition to including heteroatoms and heterogroups, each hydrocarbyl group designated by $R^1$ may independently include one or more substituent groups selected from alkoxy, amide, amine, carboxyl, epoxy, ester, ether, hydroxyl, keto, metal salt, sulfuryl, and thiol groups. Alternatively, each hydrocarbyl group designated by $R^1$ may be independently unsubstituted.

Exemplary alkyl groups include methyl, ethyl, propyl, isopropyl, n-butyl, isobutyl, sec-butyl, tert-butyl, pentyl, iso-amyl, hexyl, 2-ethylhexyl, octyl and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

As described above with respect to general formula (III), the hydrocarbyl group designated by $R^1$ may include one or more epoxy groups. These hydrocarbyl epoxy groups may be represented by the general formula (IV):

(IV)

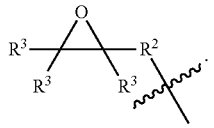

In general formula (IV), $R^2$ is a divalent hydrocarbon group and each $R^3$ may independently be a hydrogen atom or a hydrocarbyl group. The divalent hydrocarbon group designated by $R^2$ may be substituted or unsubstituted, straight or branched, alkyl, alkenyl, cycloalkyl, cycloalkenyl, aryl, alkylaryl, arylalkyl group, or combinations thereof. Each hydrocarbon group designated by $R^2$ may independently include from 1 to 100, 1 to 50, 1 to 40, 1 to 30, 1 to 20, 1 to 15, 1 to 10, 1 to 6, or 1 to 4, carbon atoms. Alternatively still, each hydrocarbyl group designated by $R^2$ may independently include less than 20, less than 15, less than 12, or less than 10, carbon atoms. Alternatively, each hydrocarbon group designated by $R^2$ may be independently substituted, and include one or more heteroatoms, such as oxygen, nitrogen, sulfur, chlorine, fluorine, bromine, or iodine, and/or one or more heterogroups, such as pyridyl, furyl, thienyl, and imidazolyl. Alternatively, or in addition to including heteroatoms and heterogroups, each hydrocarbon group designated by $R^2$ may independently include one or more substituent groups selected from alkoxy, amide, amine, carboxyl, epoxy, ester, ether, hydroxyl, keto, metal salt, sulfuryl, and thiol groups. The hydrocarbyl groups designated by $R^3$ may have the same meaning as $R^1$ as described above with respect to general formula (III). Multiple groups designated by $R^3$ may be bonded together to form a cyclic structure.

Referring again to general formula (III), if at least one $R^1$ is a hydrocarbyl group including an amide group, exemplary epoxide compounds include N-methyl 2,3-epoxypropionamide, N-ethyl 2,3-epoxypropionamide, N-propyl 2,3-epoxypropionamide, N-isopropyl 2,3-epoxypropionamide, N-butyl 2,3-epoxypropionamide, N-isobutyl 2,3-epoxypropionamide, N-tert-butyl 2,3-epoxypropionamide, N-hexyl 2,3-epoxypropionamide, N-octyl 2,3-epoxypropionamide, N-(2-ethylhexyl)-2,3-epoxypropionamide, and N-dodecyl 2,3-epoxypropanionamide.

In certain embodiments, the epoxide compound of general formula (III) may be an alkyl epoxide compound. The alkyl epoxide compound may be exemplified by 1,2-epoxybutane, 2-methyl 2,3-epoxy butane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1-,2-epoxyoctadecane, 1,2-epoxynonadecane, and 2,3-epoxy pentane.

Alternatively, in other embodiments, the epoxide compound of general formula (III) may be an alkyl glycidyl ether compound. The alkyl glycidyl ether compound may be exemplified by decyl glycidyl ether, undecyl glycidyl ether, dodecyl glycidyl ether, tridecyl glycidyl ether, tetradecyl glycidyl ether, 2-ethylhexyl glycidyl ether, neopentyl glycol diglycidyl ether, trimethylolpropane triglycidyl ether, pentaerythritol tetraglycidyl ether, 1,6-hexane diol diglycidyl ether, sorbitol polyglycidyl ether, polyalkylene glycol monoglycidyl ether, and polyalkylene glycol diglycidyl ether.

Exemplary epoxide compounds also include glycidol, glycidol derivatives, glycidyl, glycidyl derivatives, allyl 2,3-epoxypropyl ether, isopropyl 2,3-epoxypropyl ether, (tert-butoxymethyl)oxirane, and [[(2-ethylhexyl)oxy]methyl]oxirane.

In some embodiments, the epoxide compound may be an epoxide ester compound. The epoxide ester compound may be represented by general formula (V):

(V)

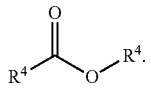

In general formula (V), each group designated by $R^4$ is independently a hydrogen atom or a hydrocarbyl group, and wherein at least one group designated by $R^4$ is an epoxy group or is a hydrocarbyl group substituted with an epoxy group. Alternatively, in certain embodiments, each group designated by $R^4$ is an epoxy group or a hydrocarbyl group substituted with at least one epoxy group. Further still, at least one of the groups designated by $R^4$ in general formula (V) may designate a cyclic hydrocarbyl group where two carbons of the oxirane ring are part of the cyclic ring. The hydrocarbyl groups designated by $R^4$ may independently have the same meaning as $R^1$ described above with respect to general formula (III).

The epoxide ester compound of general formula (V) may be exemplified by methyl 2,3-epoxypropionate, ethyl 2,3-epoxypropionate, propyl 2,3-epoxypropionate, isopropyl 2,3-epoxypropionate, butyl 2,3-epoxypropionate, isobutyl 2,3-epoxypropionate, hexyl 2,3-epoxypropionate, octyl 2,3-epoxypropionate, 2-ethylhexyl 2,3-epoxypropionate, and dodecyl 2,3-epoxypropionoate.

In certain embodiments, the epoxide ester compound of general formula (V) may be more specifically represented by general formula (VI):

(VI)

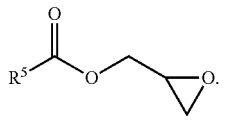

In general formula (VI), each group designated by $R^5$ may be a hydrogen atom or a hydrocarbyl group. The hydrocarbyl group designated by $R^5$ may have the same meaning as $R^1$ described above with respect to general formula (III). The epoxide ester compound of general formula (II) may be exemplified by glycidyl-2,2-dimethyl octanoate, glycidyl benzoate, glycidyl-tert-butyl benzoate, glycidyl acrylate, and glycidyl methacrylate.

In certain embodiments, the epoxide compound is a cyclic epoxide compound. The cyclic epoxide compound may be represented by general formula (VII):

(VII)

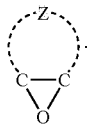

In general formula (VII), Z represents the type and number of atoms necessary to complete the cyclic ring of general formula (VII). The ring designated by Z may include from 2 to 20, 3 to 15, 5 to 15, carbon atoms. For example, the ring designated by Z may include 1, 2, 3, 4, 5, 6, 7, 8, 9, 10, 11, or 12 carbons, not accounting for the number of carbon atoms in any substituent groups. Z may be a substituted or unsubstituted, branched or unbranched, divalent hydrocarbon group that may include one or more heteroatoms, such as oxygen, nitrogen, sulfur, chlorine, fluorine, bromine, or iodine, or one or more heterogroups, such as pyridyl, furyl, thienyl, and imidazolyl. In addition to, or alternatively to, including heteroatoms and/or heterogroups, the ring designated by Z may include one or more hydrocarbyl substituent groups, such as those described for $R^2$ in general formula (III). The divalent hydrocarbon group designated by Z may be aliphatic or aromatic. In some embodiments, the divalent hydrocarbon group designated by Z may be exemplified by: cyclopropyl, cyclopentyl, cyclohexyl, phenyl, naphthalenyl, benzyl, phenylethyl, and (2-naphthyl)-methyl groups. It should be appreciated that the heteroatoms, heterogroups, and/or substituent groups described above may be bonded to various atoms in the ring designated by Z; for example, the hydrocarbyl substituent groups may be bonded directly to one or more carbons in the ring designated by Z that form part of the oxirane ring. Alternatively, the substituent groups, heterogroups, and heteroatoms may be bonded to other carbon atoms in the hydrocarbon group, such as carbons that are not part of the oxirane ring. In some embodiments, the cyclic epoxide compound of general formula (VII) may be a cycloaliphatic epoxide compound having at least two terminal oxirane rings.

The cyclic epoxide compound of general formula (VII) may be exemplified by 1,2-epoxycyclohexane, 1,2-epoxycyclopentane, 3,4-epoxycyclohexylmethyl-3,4-epoxycyclohexane carboxylate, bis(3,4-epoxy cyclohexylmethyl)adipate, bis(3,4-epoxy-6-methylcyclohexylmethyl)adipate, and 4-epoxyethyl-1,2-epoxycyclohexane.

As should be appreciated from general formulas (III), (IV), (V), (VI), and (VII) described above, the epoxide compound may be a monoepoxide, or a polyepoxide compound, such as a diepoxide. The polyepoxide compound includes at least two oxirane rings. Furthermore, in some embodiments, the polyepoxide compound may include fewer than 10, fewer than 8, fewer than 5, fewer than 4, or fewer than 3, oxirane rings per molecule.

The polyepoxide compound may include one or more substituted or unsubstituted, branched or unbranched, hydrocarbyl or divalent hydrocarbon groups, such alkyl, alkenyl, cycloalkyl, alkylcycloalkyl, aryl, alkylaryl group, arylalkyl groups, and combinations thereof. Each hydrocarbyl or divalent hydrocarbon group included in the polyepoxide compound may independently be substituted with one or more heteroatoms, such as oxygen, nitrogen, sulfur, chlorine, bromine, fluorine, or iodine, and/or may independently include one or more heterogroups, such as pyridyl, furyl, thienyl, and imidazolyl. Each hydrocarbyl or divalent hydrocarbon group in the polyepoxide compound may include one or more substituent groups selected from alkoxy, amide, amine, carboxyl, epoxy, ester, ether, hydroxyl, keto, metal salt, sulfuryl, and thiol groups. Each of the hydrocarbyl or divalent hydrocarbon groups in the polyepoxide compound may independently include from 1 to 100, 1 to 50, 1 to 40, 1 to 30, 1 to 20, 1 to 10, 1 to 6, or 1 to 4, carbon atoms. The hydrocarbyl or divalent hydrocarbon groups may be bonded to one another or to one or more carbon atoms of the oxirane rings to form the polyepoxide compound.

In some embodiments, the polyepoxide compound may be represented by the general formula (VIII):

(VIII)

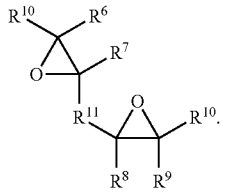

In general formula (VIII), $R^6$, $R^7$, $R^8$, $R^9$ and $R^{10}$ are each independently a hydrogen atom or a hydrocarbyl group. $R^{11}$ is a divalent hydrocarbon group. The hydrocarbyl groups designated by $R^6$, $R^7$, $R^8$, $R^9$, and $R^{10}$ in general formula (VIII) may have the same meaning as described above with respect to $R^1$ in general formula (III). The divalent hydrocarbon group designated by $R^{11}$ in general formula (VIII) may have the same meaning as described above with respect to $R^2$ in general formula (IV). In certain embodiments, $R^6$ and $R^7$, together with the two carbons of the oxirane ring, form a cyclic structure. In other embodiments, $R^8$ and $R^9$, together with the two carbons of the oxirane ring, form a cyclic structure. As such, the polyepoxide compound of general formula (VIII) may include one, two, or more than two, cyclic rings. Furthermore, in certain embodiments, at least one, or at least two, of the oxirane oxygens in general formula (VIII) is directly bonded to two cyclic carbons, i.e., carbons which form part of a cyclic ring.

Alternatively, the polyepoxide compound may be represented by general formula (IX) shown below:

(IX)

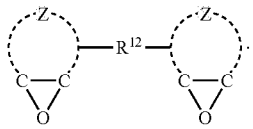

In general formula (IX), each Z may have the same meaning as described above with respect to general formula (IX). In general formula (IX), $R^{12}$ is a divalent hydrocarbon group. $R^{12}$ may have the same meaning as described above with respect to $R^2$ in general formula (IV). It should be appreciated that the divalent hydrocarbon group designated by $R^{12}$ may be bonded to various atoms in the divalent hydrocarbon group designated by Z. For example, the divalent hydrocarbon group designated by $R^{12}$ may be bonded directly to one or more oxirane ring carbons in certain embodiments. Alternatively, the divalent hydrocarbon group designated by $R^{12}$ may be bonded to non-oxirane ring carbon atoms in the hydrocarbon group designated by Z.

The polyepoxide compound of general formula (IX) may be exemplified by:

3-(1-(6-oxabicyclo[3.1.0]hexan-3-yl)propyl)-7-oxabicyclo[4.1.0]heptane:

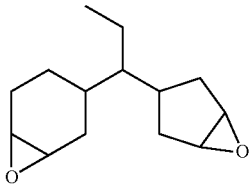

3-((7-oxabicyclo[4.1.0]heptan-3-yl)methyl)-8-oxabicyclo[5.1.0]octane:

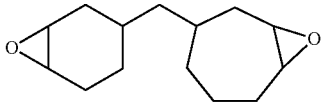

4-[1-(7-oxabicyclo[4.1.0]heptan-4-yl)propyl]-7-oxabicyclo[4.1.0]heptane:

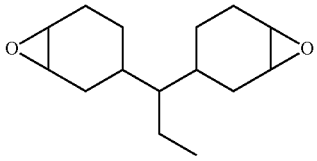

4-[1-methyl-1-(7-oxabicyclo[4.1.0]heptan-4-yl)ethyl]-7-oxabicyclo[4.1.0]heptane:

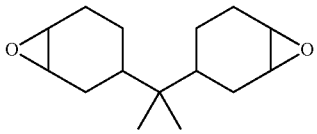

In one embodiment, the polyepoxide compound may be a polyepoxide ester compound including at least two oxirane rings. In certain embodiments, the polyepoxide ester compound may be exemplified by the general formula (X):

(X)

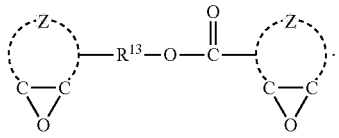

In general formula (X), each Z may have the same meaning as described above with respect to general formula (VII). In general formula (X), $R^{13}$ is a divalent hydrocarbon group. $R^{13}$ may have the same meaning as described above with respect to $R^2$ in general formula (IV). It should be appreciated that the divalent hydrocarbon group designated by $R^{13}$ may be bonded to various atoms in the divalent hydrocarbon group designated by Z. For example, the divalent hydrocarbon group designated by $R^{13}$ may be bonded directly to one or more oxirane ring carbons in certain embodiments. Alternatively, the divalent hydrocarbon group designated by $R^{13}$ may be bonded to non-oxirane ring carbon atoms in the ring designated by Z. In one embodiment, the epoxide compound of general formula (X) is a 3,4-epoxycycloalkyl, 3,4-epoxycycloalkyl carboxylate, such as 3,4-epoxycyclohexylmethyl, 3,4-epoxy-cyclohexane carboxylate. The polyepoxide ester compound of general formula (X) may be exemplified by:

3-((7-oxabicyclo[4.1.0]heptane-3-carbonyl)oxy)propyl 9-oxabicyclo[6.1.0]nonane-4-carboxylate:

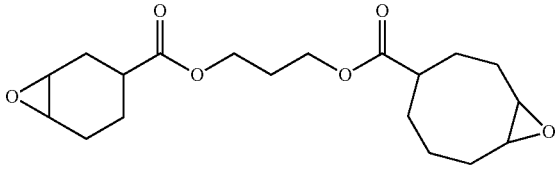

7-((6-oxabicyclo[3.1.0]hexan-2-yl)methoxy)heptyl 7-oxabicyclo[4.1.0]heptane-3-carboxylate:

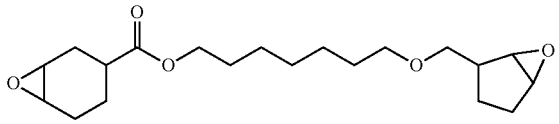

3-((7-oxabicyclo[4.1.0]heptane-3-carbonyl)oxy)-2-(methoxymethyl)-2-methylpropyl 7-oxabicyclo[4.1.0]heptane-2-carboxylate:

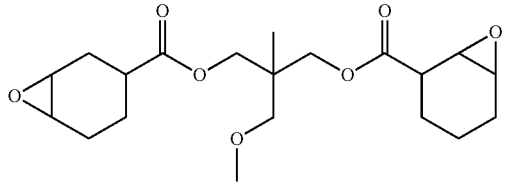

3-(7-oxabicyclo[4.1.0]heptane-4-carbonyloxy)propyl 7-oxabicyclo[4.1.0]heptane-4-carboxylate:

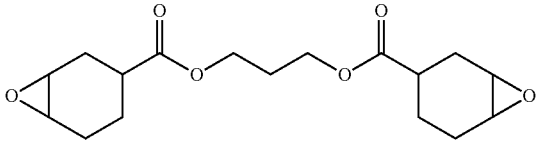

7-(7-oxabicyclo[4.1.0]heptan-4-ylmethoxy)heptyl 7-oxabicyclo[4.1.0]heptane-4-carboxylate:

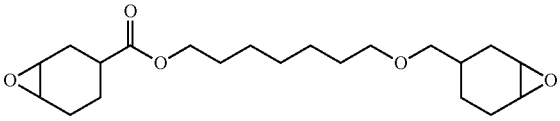

-continued

[2-(methoxymethyl)-2-methyl-3-(7-oxabicyclo[4.1.0]heptane-4-carbonyloxy)propyl] 7-oxabicyclo[4.1.0]heptane-4-carboxylate:

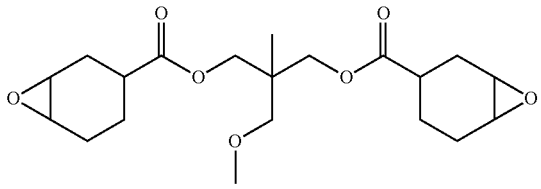

Alternatively still, the epoxide compound may be exemplified by general formula (XI):

$$[A]_w[B]_x \quad (XI)$$

In general formula (XI), each A is independently a hydrocarbyl group or a divalent hydrocarbon group and each B is an epoxy group. The group designated by A may have the same meaning as described above with respect to $R^1$ in general formula (III) or $R^2$ in general formula (IV). "w" is an integer having a value of from 0 to 50, and "x" is an integer having a value of from 0 to 10, where $w+x \geq 1$, and with the proviso that if x=0, at least one moiety designated by A is a hydrocarbyl group including an epoxy substituent group. "w" may be an integer having a value of from 1 to 40, 1 to 30, 1 to 20, 1 to 10, 1 to 8, 1 to 5, or 1 to 3, and "x" may be an integer having a value of 10, 9, 8, 7, 6, 5, 4, 3, 2, or 1. It should be appreciated that groups A and B in general formula (XI) may be bonded to one another in any order, with varying number of iterations.

The epoxide compound may be exemplified by the following compounds:

2,2′-[ethane-1,2-diylbis(oxymethandiyl)]dioxirane:

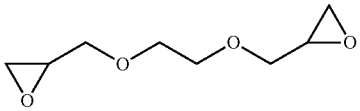

2,2′-[butane-1,4-diylbis(oxymethandiyl)]dioxirane:

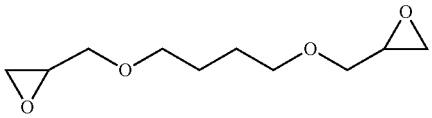

2,2′-[ethane-1,2-diylbis(sulfanediylmethandiyl)]dioxirane:

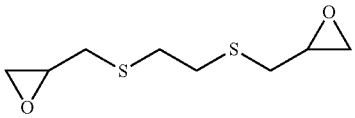

bis(oxiran-2-ylmethyl) hexanedioate:

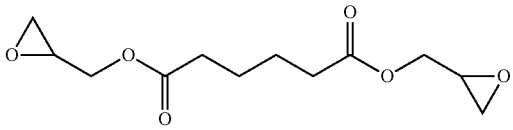

bis(oxiran-2-ylmethyl) butanedioate:

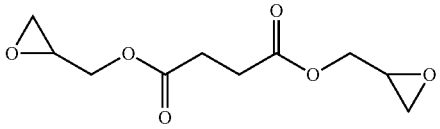

-continued bis(oxiran-2-ylmethyl) (2E)-but-2-enedioate:

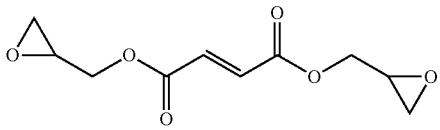

2,2′-butane-1,4-diydioxirane:

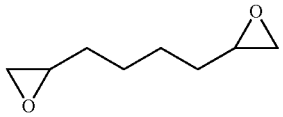

2,2′-[benzene-1,3-diybis(oxymethanediyl)]dioxirane:

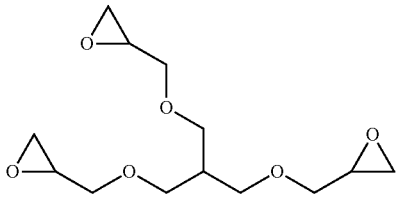

2-({3-(oxiran-2-ylmethoxy)-2-[(oxiran-2-ylmethoxy)methyl]propoxy}methyl)oxirane:

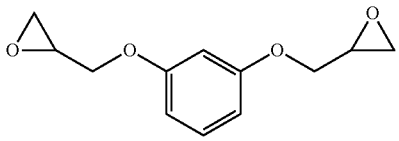

3-(oxiran-2-yl)-8-oxabicyclo[5.1.0]octane:

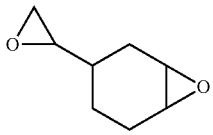

8-oxabicyclo[5.1.0]oct-3-ylmethyl 8-oxabicyclo[5.1.0]octane-3-carboxylate:

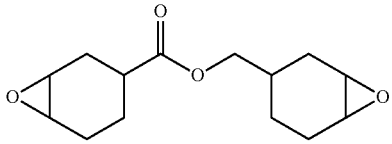

N-methyl 2,3-epoxypropionamide:

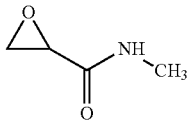

1,2-epoxybutane:

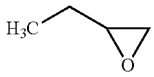

decyl glycidyl ether:

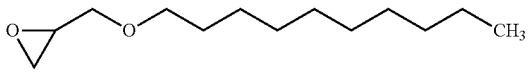

-continued trimethylolpropane triglycidyl ether:

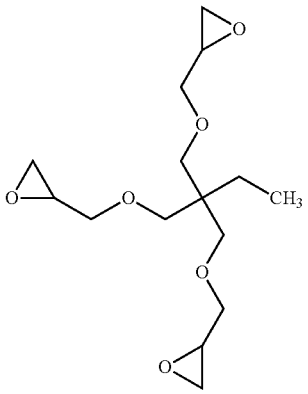

glycidol:

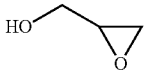

[[(2-ethylhexyl)oxy]methyl]oxirane:

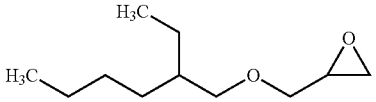

methyl 2,3-epoxypropionate:

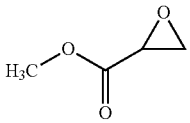

glycidyl-2,2-dimethyl octanoate:

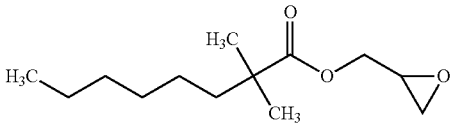

glycidyl benzoate:

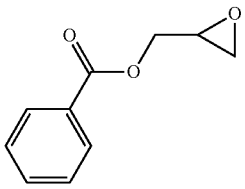

glycidyl acrylate:

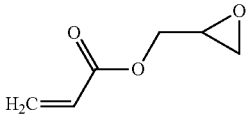

1,2-epoxycyclohexane:

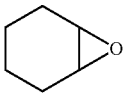

-continued bis(3,4-epoxy cyclohexylmethyl) adipate:

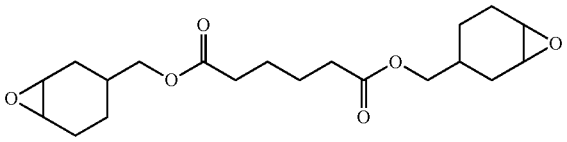

exp-2,3-epoxynorbornane:

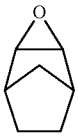

4-(1′-methylepoxyethyl)-1,2-epoxy-2-methylcyclohexane:

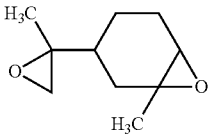

3,4-epoxycyclohexylmethyl, 3,4-epoxy-cyclohexane carboxylate:

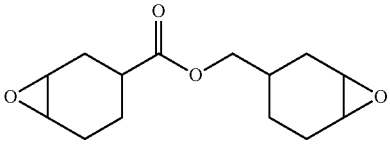

It should be appreciated that all of these exemplary compounds fall within the scope of one or more of the general formulas (III), (IV), (V), (VI), (VII), (VIII), (IX), (X), and (XI) and/or within the scope of the written description of the epoxide compound herein.

In certain embodiments, the epoxide compound may be free from nitrogen, sulfur, phosphorous, chlorine, bromine, and/or iodine atoms. As described above, the epoxide compound may be aliphatic, cyclic, acyclic, and/or aromatic.

The epoxide compound may have a weight average molecular weight of from 44 to 1000, 50 to 750, 100 to 500, 100 to 400, or 100 to 200. Alternatively still, the epoxide compound may have a weight average molecular weight of at least 30, at least 50, at least 70, at least 90, at least 110, or at least 130. Alternatively, the epoxide compound may have a weight average molecular weight of less than 1500, less than 1300, less than 1100, less than 900, less than 700, less than 500, less than 400, or less than 300.

The epoxide compound may have an epoxide equivalent weight of from 75 to 300, 75 to 250, 75 to 200, 85 to 190, 85 to 175, 95 to 160, or 100 to 145, g per mole of oxirane ring of the epoxide compound. Alternatively, the epoxide compound may have an epoxide equivalent weight of at least 50, 60, 70, 80, 90, 100, 110, 120, 130, 140, or 150, g per mole of oxirane ring of the epoxide compound. As referred to throughout this disclosure, the term "epoxide equivalent weight" is the numerical value which is obtained by dividing the weight average molecular weight of the epoxide compound by the number of oxirane rings in the molecule.

The basicity effect of the epoxide compound can be determined by acid titration. The resulting neutralization number is expressed as the total base number (TBN), and can be measured using various methods. ASTM D4739 is a potentiometric hydrochloric acid titration. The ASTM D4739 method is favored in engine tests and with used oils to measure TBN depletion/retention. When testing used engine lubricants, it should be recognized that certain weak bases are the result of the service rather than having been built into the oil. This test method can be used to indicate relative changes that occur in lubricant composition during use under oxidizing or other service conditions regardless of the color or other properties of the resulting lubricant composition.

In some embodiments, the epoxide compound does not negatively affect the total base number of the lubricant composition. Alternatively, the epoxide compound may improve the TBN of the lubricant composition by, at least 0.5, 1, 1.5, 2, 2.5, 3, 3.5, 4, 4.5, 5, 10, or 15, mg KOH/g of epoxide compound. The TBN value of the lubricant composition can be determined according to ASTM D2896 and/or ASTM D4739 as will be described below.

In certain embodiments, the epoxide compound is monomeric. The term "monomeric" is intended to indicate that the subject compound does not include more than three, more than two, or more than one, repeating monomer units bonded to one another. Alternatively, the term monomeric may refer to compounds that do not include any repeating monomer units. In other words, the term "monomeric" is intended to exclude compounds which are either oligomeric or polymeric. In certain embodiments, the monomeric epoxide compound excludes oils or alkyl fatty acid esters which have been epoxidized to include one or more oxirane rings, such as epoxidized vegetable oils. Alternatively, the lubricant composition or additive package may include less than 5, 4, 3, 2, 1, 0.5, 0.1, or 0.01, wt. %, of an epoxidized fatty acid ester or epoxidized oil based on a total weight of the lubricant composition. As used herein, the term "epoxidized oil" refers to a natural oil which was epoxidized to include at least 1, at least 2, at least 3, at least 4, at least 5, at least 6, at least 7, at least 8, or at least 9, epoxide groups per molecule and/or has an epoxide equivalent weight of greater than 200, 250, 300, or 350. As used herein, the term "epoxidized fatty acid ester" refers to a natural fatty acid ester or acid that includes at least 1, at least 2, at least 3, at least 4, at least 5, at least 6, at least 7, at least 8, or at least 9, epoxide groups per molecule and/or has a epoxide equivalent weight of greater than 200, 250, 300, or 350. As used herein, the term "natural" refers to compounds which are naturally-occurring.

The epoxide compound may have a boiling point of at least 50, 60, 70, 80, 90, 100, 110, 120, 130, 140, or 150, ° C., at 1 atmosphere of pressure. Alternatively, the epoxide compound has a boiling point of from 50 to 450, 55 to 450, 65 to 450, 75 to 450, 85 to 450, 100 to 450, 115 to 450, 125 to 450, 135 to 450, 150 to 450, or from 200 to 400, ° C., at 1 atmosphere of pressure. Furthermore, in certain embodiments, the epoxide compound is a liquid at a steady state temperature of 50° C. and a steady state pressure of 1 atmosphere of pressure.

The epoxide compound may have a flash point of from 25 to 250, 50 to 250, 65 to 250, 75 to 250, 100 to 250, or from 115 to 250, ° C. at 1 atmosphere of pressure. Alternatively, the epoxide compound may have a flash point of at least 25, 35, 45, 55, 65, 75, 85, 95, 105, 115, 125, or 135, ° C. at 1 atmosphere of pressure.

The epoxide compound may be prepared using various methods as will be appreciated by one of ordinary skill in the art. For example, the epoxide compound may be prepared by the epoxidation of an allyl ether, α,β-unsaturated amide to the corresponding glycidyl ether, glycidic ester, or glycidic amide. Alternatively, an olefin may be epoxidized with hydrogen peroxide and an organic peracid to produce the epoxide compound. Alternatively, the olefin can be epoxidized in the presence of a transition metal catalyst and a co-oxidant to form the epoxide compound. Suitable co-oxidants include hydrogen peroxide, tert-butyl hydroperoxide, iodosylbenzene, sodium hypocholorite, and the like. Alternatively, glycidic esters may be prepared by Darzens condensation of an α-halo ester and an aldehyde or ketone, in the presence of a base.

In some embodiments, the lubricant composition and/or additive package is free of, or contains less than 5, 3, 1, 0.5, 0.1, or 0.05, wt. %, of an epoxide reaction catalyst, based on the total weight of the lubricant composition. The epoxide reaction catalyst may be a metal salt, such as a metallic salt of fatty acids, naphthenates, phenolates, alcoholates, carboxylates, and the corresponding thio analogues, sulfonates, and sulphinates. The epoxide reaction catalyst may also refer to calcium cetyl alcoholate, barium isoamyl thiiphenolate, calcium naphthnate, and metal salts of alkyl substituted benzene sulphonic acid. In some embodiments, the epoxide reaction catalyst is defined as a component that catalyzes the reaction of the epoxide compound with an additional component in the lubricant composition at a temperature less than 100, 80, or, 60, ° C. The additional component may include, but is not limited to, any compound described in this specification other than the epoxide reaction catalyst and the epoxide compound. For example, the additional component referred to above may be a dispersant, an antiwear additive, an antioxidant, or a component that affects the total base number of the lubricant composition.

Conventional uses of epoxide compounds in lubricant compositions involve forming a reaction product between a conventional dispersant and a conventional epoxide compound. In these applications, the conventional epoxide compound is consumed by chemical reactions such that the ultimately formed lubricant composition does not contain appreciable amounts of the conventional epoxide compound in an unreacted state. The conventional epoxide compound may react via an addition reaction such that the addition of one or more small molecules to the lubricant composition may cause the epoxide group of the conventional epoxide compound to ring-open without eliminating or cleaving any part of the conventional epoxide compound.

In such conventional uses, more than 50 wt. % of the conventional epoxide compound is typically reacted with the conventional dispersants or other compounds based on the total weight of the conventional epoxide compound in the lubricant composition prior to the reaction. In certain embodiments, at least 50, 60, 70, 80 or, 90, wt. % of the epoxide compound remains unreacted in the lubricant composition based on a total weight of the epoxide compound utilized to form the lubricant composition prior to any reaction in the lubricant composition. Alternatively, at least 95, 96, 97, 98, or 99, wt. %, of the epoxide compound remains unreacted in the lubricant composition based on a total weight of the epoxide compound prior to any reaction in the lubricant composition.

In certain embodiments, the lubricant composition includes less than 10, 5, 1, 0.5, 0.1, 0.01, 0.001, or 0.0001, wt. %, of compounds which would react with the epoxide compound at a temperature less than 150, less than 125, less than 100, or less than 80, ° C., based on a total weight of the lubricant composition. Exemplary types of compounds which may react with the epoxide compound at a temperature less than 100° C. include acids, amine curing agents, anyhydrides, triazoles, and/or oxides. In certain embodiments, the lubricant composition may include a collective amount of acids, amine curing agents, anhydrides, triazoles, and/or oxides which is less than 5, 3, 1, 0.5, or 0.1, wt. % based on a total weight of the lubricant composition. Alternatively, the lubricant composition may include a collective amount of acids, amine curing agents, anhydrides, triazoles, and/or oxides which is less than 0.01, 0.001, or 0.0001, wt. %, based on the total weight of the lubricant composition. Alternatively still, the lubricant composition may be free of acids, amine curing agents, anhydrides, triazoles, and/or oxides.

In other conventional uses, conventional epoxide compounds undergo tribopolymerization in lubricant compositions to form protective lubricating films. In the tribopolymerization process, polymer-formers are adsorbed on a solid surface and polymerize under rubbing conditions to form organic polymeric films directly on the rubbing surface. In such conventional uses, more than 50 wt. % of the conventional epoxide compound is typically reacted via tribopolymerization. In contrast, the inventive lubricant compositions may contain a significant amount of the epoxide compound that does not react via tribopolymerization. In certain embodiments, at least 50, 60, 70, 80, or 90, wt. %, of the epoxide compound does not react via tribopolymerization in the lubricant composition at a temperature less than 100, 80, or 60, ° C., based on the total weight of epoxide compound utilized to form the lubricant composition. Alternatively, at least 95, 96, 97, 98, or 99, wt. %, of the epoxide compound does not react via tribopolymerization in the lubricant composition at a temperature less than 100, 80, or 60, ° C., based on a total weight of the epoxide compound in the lubricant composition.

In other embodiments, the second seal compatibility additive is the boroxine compound. As such, the boroxine compound may be included in a lubricant composition or an additive package for a lubricant composition to improve the seal compatibility of the lubricant composition.

The boroxine compound may be represented by general formula (XII):

(XII)

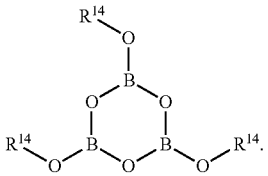

In general formula (XII), each $R^{14}$ is independently an alkyl group having equal to or fewer than 7 carbon atoms. For example, each $R^{14}$ may independently be an alkyl group having from 1 to 7, 1 to 6, 1 to 5, 1 to 4, 1 to 3, or 1 to 2, carbon atoms. Each $R^{14}$ may independently be linear or branched. In one formulation, each $R^{14}$ may be a methyl group. Exemplary $R^{14}$ groups may independently include methyl, ethyl, n-propyl, iso-propyl, n-butyl, sec-butyl, tert-butyl, and n-hexyl groups.

The boroxine compound may include, but is not limited to, trimethoxy boroxine, tripropoxy boroxine, triisopropoxy boroxine, tributoxy boroxine, tripentoxy boroxine, trihexoxy boroxine, and triheptoxy boroxine. By way of example, trimethoxy boroxine may be exemplified by the formula:

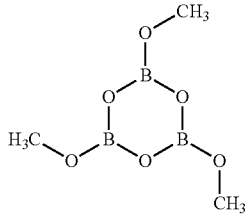

In certain embodiments, each $R^{14}$ may represent distinct alkyl groups. For example, the boroxine compound may be exemplified by the formula:

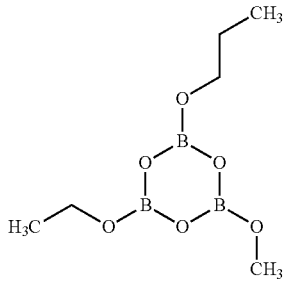

where one group designated by $R^{14}$ in general formula (XII) is methyl, one group designated by $R^{14}$ in formula (XII) is ethyl, and one group designated by $R^{14}$ in formula (XII) is propyl. Alternatively still, groups designated by $R^{14}$ may be the same, and one group designated by $R^{14}$ may be different in general formula (XII).

The boroxine compound may be prepared via numerous methods. As but one example, the boroxine compound can be prepared by reacting 2 mole of orthoboric acid ($H_3BO_3$) with 1 mole tri-alkyl borate. The alkyl borate may have from 1 to 7 carbon atoms, depending on the number of carbon atoms desired in the groups designated by $R^{14}$ in general formula (XII). The reaction can be conducted at a temperature ranging from 50 to 150° C. in order to remove 1 mol $H_2O$.

Conventional uses of conventional boron compounds involve forming a reaction product between a conventional amine compound and a conventional boron compound. The conventional boron compound may be exemplified by reactive borate esters and boric acids. In these applications, the conventional boron compound is consumed by chemical reactions such that the ultimately formed lubricant composition does not contain appreciable amounts of the conventional boron compound. Furthermore, in these applications, the conventional amine compound is reacted with the conventional boron compound to form a salt. The salt formation is evidenced by the electronic impact upon the reaction of the conventional boron compound and the conventional amine compound, which is visible as a chemical shift in NMR spectroscopy. There are also physical indications that a reaction takes place, such as the evolution of heat and the thickening of the solution (cross-linking).

In such applications of conventional boron compounds, more than 50 wt. % of the conventional boron compound is typically reacted with the conventional amine compounds, or is hydrolyzed, based on the total weight of the conventional boron compound before reaction. The lubricant composition may be free from a salt formed through the reaction of the boroxine compound, or may contain less than 10, less than 5, or less than 1, wt. %, of the salt formed through the reaction of the boroxine compound based on the total weight of the lubricant composition after any reaction.

In certain embodiments, at least 50, at least 60, at least 70, at least 80, or at least 90, wt. %, of the boroxine compound remains unreacted in the lubricant composition based on a total weight of boroxine compound utilized to form the lubricant composition prior to any reaction in the lubricant composition. Alternatively, at least 95, at least 96, at least 97, at least 98, or at least 99, wt. %, of the boroxine compound remains unreacted in the lubricant composition based on a total weight of the boroxine compound prior to any reaction in the lubricant composition.

In one embodiment, the percentage of the boroxine compound that remains unreacted is determined after all of the components which are present in the lubricant composition reach equilibrium with one another. The time period necessary to reach equilibrium in the lubricant composition may vary widely. For example, the amount of time necessary to reach equilibrium may range from a single minute to many days, or even weeks. In certain embodiments, the percentage of the boroxine compound that remains unreacted in the lubricant composition is determined after 1 minute, 1 hour, 5 hours, 12 hours, 1 day, 2 days, 3 days, 1 week, 1 month, 6 months, or 1 year. Generally, the percentage of the boroxine compound that remains unreacted in the lubricant composition is determined before an end use.

In certain embodiments, the lubricant composition includes less than 0.1, less than 0.01, less than 0.001, or less than 0.0001, wt. %, of compounds which would react with the boroxine compound based on the total weight of the lubricant composition.

The lubricant composition may include less than 100, less than 50, less than 10, or less than 5, ppm $B(OH)_3^-$ ions, based the total weight of the lubricant composition. Conventional boroxine compounds may be hydrolyzed before they are combined with a conventional lubricant composition such that more than 100 ppm $B(OH)_3^-$ ions are present in the conventional lubricant composition. In other words, at least 50, at least 60, at least 70, at least 80, at least 90, at least 95, or at least 99, wt. %, of the boroxine compound is in an unhydrolyzed state in the lubricant composition based on the total weight of the boroxine compound. The amount of the boroxine compound which is hydrolyzed is accounted for when determining the amount of the boroxine compound which remains unreacted.

Furthermore, the boroxine compound does not negatively affect the total base number (TBN) of the lubricant composition. The TBN value of the lubricant composition can be determined according to ASTM D2896 and ASTM D4739 as will be described below.

In other embodiments, the second seal compatibility additive is the sulfonate ester. As such, the sulfonate ester may be included in a lubricant composition or an additive package for a lubricant composition to improve the seal compatibility of the lubricant composition.

It should be understood that, in certain aspects, the sulfonate ester may take many forms, so long as the sulfonate ester includes a sulfonate group. For example, the sulfonate ester may refer to mono-sulfonate esters, di-sulfonate esters, tri-sulfonate esters, and sulfonate esters including four or more sulfonate groups. It is also contemplated that two or more different, or two or more of the same, sulfonate groups may be present in the same sulfonate ester. For example, the sulfonate ester may include at least one mesylate group and at least one tosylate group in the same molecule.

In one aspect, the sulfonate ester has the following general formula (XIII):

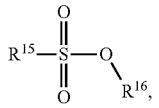

(XIII)

wherein $R^{15}$ and $R^{16}$ are each independently selected hydrocarbyl groups. Each hydrocarbyl group designated by $R^{15}$ and $R^{16}$ may independently be substituted or unsubstituted, straight or branched, alkyl, alkenyl, cycloalkyl, cycloalkenyl, aryl, alkylaryl, arylalkyl group, or combinations thereof. Each hydrocarbyl group designated by $R^{15}$ and $R^{16}$ may independently include from 1 to 100, 1 to 50, 1 to 40, 1 to 30, 1 to 20, 1 to 17, 1 to 15, 1 to 10, 1 to 6, or 1 to 4, carbon atoms. Alternatively, each hydrocarbyl group designated by $R^{15}$ and $R^{16}$ may independently include less than 20, less than 15, less than 12, or less than 10, carbon atoms. Exemplary alkyl groups include methyl, ethyl, propyl, isopropyl, n-butyl, isobutyl, sec-butyl, tert-butyl, pentyl, isoamyl, hexyl, 2-ethylhexyl, octyl, cetyl, 3,5,5-trimethylhexyl, 2,5,9-trimethyldecyl, and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

In some embodiments, the sulfonate ester is free from, or includes a limited number of certain substituent groups. For example, the sulfonate ester may include fewer than three, fewer than two, one, or be completely free from, carbonyl groups. In other aspects, the sulfonate ester is free from an estolide groups (and is not an estolide). In still other aspects, the sulfonate ester is free from metal ions and/or other ions.

In certain aspects, each hydrocarbyl group designated by $R^{15}$ and $R^{16}$ may be independently substituted, and include at least one heteroatom, such as oxygen, nitrogen, sulfur, chlorine, fluorine, bromine, or iodine, and/or at least one heterogroup, such as pyridyl, furyl, thienyl, and imidazolyl. Alternatively, or in addition to including heteroatoms and heterogroups, each hydrocarbyl group designated by $R^{15}$ and $R^{16}$ may independently include at least one substituent group selected from alkoxy, amide, amine, carboxyl, epoxy, ester, ether, hydroxyl, keto, sulfonate, sulfuryl, and thiol groups. For example, each hydrocarbyl group designated by $R^{15}$ and $R^{16}$ may include a hydrocarbyl group that includes a sulfonate group. Alternatively still at least one hydrocarbyl group designated by $R^{15}$ and $R^{16}$ may include a hydrocarbyl group that includes at least two sulfonate groups.

In one embodiment, the sulfonate ester of general formula (XIII) is cyclic, meaning that at least one group designated by $R^{15}$ and $R^{16}$ is cyclic, or that $R^{15}$ or $R^{16}$ include a pendant cyclic group. In other aspects, the sulfonate ester of general formula (XIII) is acyclic hydrocarbyl groups, meaning that both $R^{15}$ and $R^{16}$ are acyclic and that $R^{15}$ and $R^{16}$ are free from pendant cyclic groups. Alternatively still, with respect to general formula (XIII), $R^{15}$ is a methyl group and $R^{16}$ is a hydrocarbyl group having from 1 to 17 carbon atoms; $R^{15}$ is a methyl group and $R^{16}$ may be an alkyl group having from 1 to 17 carbon atoms; $R^{15}$ is a methylbenzyl group and $R^{16}$ is a hydrocarbyl group having from 1 to 17 carbon atoms; or $R^{15}$ is a methylbenzyl group and $R^{16}$ may be an alkyl group having from 1 to 17 carbon atoms.

Alternatively, as contemplated by general formula (XIII), in other aspects, $R^{15}$ is selected from a p-nitrobenzenesulfonate and a p-bromobenzenesulfonate, and $R^{16}$ is a hydrocarbyl group having from 1 to 17 carbon atoms.

In some aspects, the sulfonate ester is free from ionic bonds. In other words, the bonds present between the atoms of the sulfonate ester in this aspect consist solely of covalent bonds. As such, the sulfonate ester is not a salt.

The sulfonate ester may have a weight average molecular weight ranging from 96 to 1500, 100 to 1000, 100 to 500, 150 to 500, or 250 to 400.

In some aspects, the sulfonate ester may include 1 to 50, 1 to 40, 5 to 30, 5 to 25, or 10 to 25, mole % sulfur, based on the total number of moles in the sulfonate ester.

By way of example, the sulfonate esters encompassed by general formula (XIII) and the above description may be exemplified by one or more of the following compounds:

Cetyl mesylate:

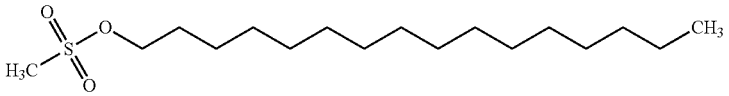

3,5,5-Trimethylhexyl methanesulfonate:

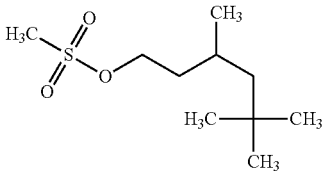

2,5,9-Trimethyldecyl methanesulfonate:

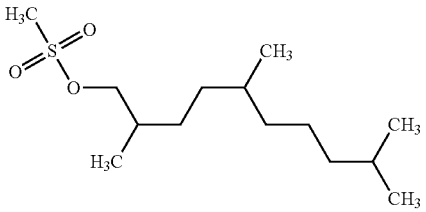

(2,4-Dimethyl-5-octylsulfonyloxy-pentyl) octane-1-sulfonate:

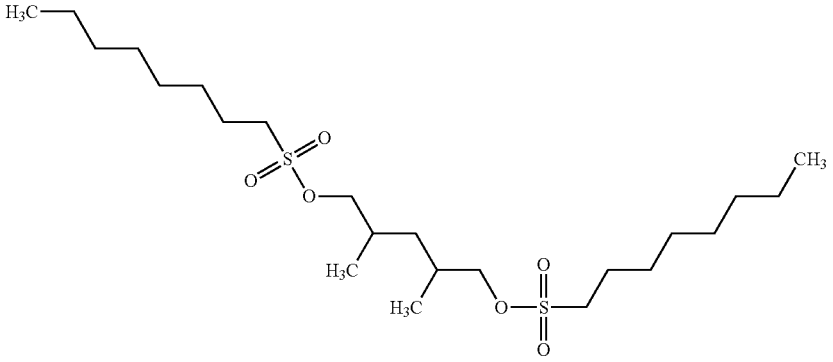

Hexyl 4-methylbenezene sulfonate:

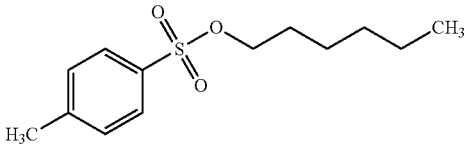

The sulfonate ester may be synthesized in a variety of ways. For example, the sulfonate may be formed by alcoholysis of sulfonyl chlorides by the following reaction mechanism:

$$R^{15}SO_2Cl+R^{16}OH \rightarrow R^{15}SO_2OR^{16}+HCl,$$

where $R^{15}$ and $R^{16}$ are each independently hydrocarbyl groups as described above in general formula (XIII). However, it should be appreciated that other methods of synthesizing the sulfonate ester are also contemplated.

In certain embodiments, at least 50, at least 60, at least 70, at least 80 or, at least 90, wt. %, of the sulfonate ester remains unreacted in the additive package and/or lubricant composition based on the total weight of sulfonate ester utilized to form the additive package and/or the lubricant composition prior to any reaction in the additive package or the lubricant composition. Alternatively, at least 95, at least 96, at least 97, at least 98, or at least 99, wt. %, of the sulfonate ester remains unreacted in the additive package and/or the lubricant composition based on the total weight of the sulfonate ester prior to any reaction in the additive package or the lubricant composition.

The halide seal compatibility additive and the second seal compatibility additive may be combined with an amine compound in the lubricant composition or additive package. It should be appreciated that mixtures of different amine compounds may also be combined with the halide seal compatibility additive and the second seal compatibility additive in the lubricant composition and/or additive package.

The amine compound includes at least one nitrogen atom. Furthermore, in some configurations, the amine compound does not include triazoles, triazines, or similar compounds where there are three or more nitrogen atoms in the body of a cyclic ring. The amine compound may be aliphatic.

In certain embodiments, the amine compound has a total base number (TBN) value of at least 10 mg KOH/g when tested according to ASTM D4739. Alternatively, the amine compound has a TBN value of at least 15, at least 20, at least 25, at least 90, at least 100, at least 110, at least 120, at least 130, at least 140, at least 150, or at least 160, mg KOH/g, when tested according to ASTM D4739. Alternatively still, the amine compound may have a TBN value of from 80 to 200, 90 to 190, 100 to 180, or 100 to 150, mg KOH/g, when tested according to ASTM D4739.

In some embodiments, the amine compound does not negatively affect the TBN of the lubricant composition. Alternatively, the amine compound may improve the TBN of the lubricant composition by, at least 0.5, at least 1, at least 1.5, at least 2, at least 2.5, at least 3, at least 3.5, at least 4, at least 4.5, at least 5, at least 10, or at least 15, mg KOH/g of the amine compound. The TBN value of the lubricant composition can be determined according to ASTM D2896.

In some embodiments, the amine compound consists of, or consists essentially of, hydrogen, carbon, nitrogen, and oxygen. Alternatively, the amine compound may consist of, or consist essentially of, hydrogen, carbon, and nitrogen. In the context of the amine compound, the phrase "consist essentially of" refers to compounds where at least 95 mole % of the amine compound are the recited atoms (i.e., hydrogen, carbon, nitrogen, and oxygen; or hydrogen, carbon, and nitrogen). For example, if the amine compound consists essentially of hydrogen, carbon, nitrogen, and oxygen, at least 95 mole % of the amine compound is hydrogen, carbon, nitrogen, and oxygen. In certain configurations, at least 96, at least 97, at least 98, at least 99, or at least 99.9, mole %, of the amine compound are hydrogen, carbon, nitrogen and oxygen, or, in other embodiments, are carbon, nitrogen, and hydrogen.

The amine compound may consist of covalent bonds. The phrase "consist of covalent bonds" is intended to exclude those compounds which bond to the amine compound through an ionic association with at least one ionic atom or compound. That is, in configurations where the amine compound consists of covalent bonds, the amine compound excludes salts of amine compounds, for example, phosphate amine salts and ammonium salts. As such, in certain embodiments, the lubricant composition is free of a salt of the amine compound. More specifically, the lubricant composition may be free of a phosphate amine salt, ammonium salt, and/or amine sulfate salt.

The amine compound may include a monomeric acyclic amine compound having a weight average molecular weight of less than 500. Alternatively, the monomeric acyclic amine compound may have a weight average molecular weight of less than 450, less than 400, less than 350, less than 300, less than 250, less than 200, or less than 150. Alternatively still, the amine compound may have a weight average molecular weight of at least 30, at least 50, at least 75, at least 100, at least 150, at least 200, or at least 250.

The phrase "acyclic amine compound" is intended to refer to amine compounds which are free from any cyclic structures and to exclude aromatic structures. For example, the monomeric acyclic amine compound does not include compounds having a ring having at least three atoms bonded together in a cyclic structure and those compounds including benzyl, phenyl, or triazole groups.

The monomeric acyclic amine compound may be exemplified by general formula (XIV):

(XIV)

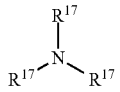

where each $R^{17}$ is independently a hydrogen atom or a hydrocarbyl group. Each hydrocarbyl group designated by $R^{17}$ may independently be substituted or unsubstituted, straight or branched, alkyl, alkenyl, cycloalkyl, cycloalkenyl, aryl, alkylaryl, arylalkyl group, or combinations thereof. Each hydrocarbyl group designated by $R^{17}$ may independently include from 1 to 100, 1 to 50, 1 to 40, 1 to 30, 1 to 20, 1 to 15, 1 to 10, 1 to 6, or 1 to 4, carbon atoms. Alternatively, each hydrocarbyl group designated by $R^{17}$ may independently include less than 20, less than 15, less than 12, or less than 10, carbon atoms.

Alternatively, each hydrocarbyl group designated by $R^{17}$ may be independently substituted, and include at least one heteroatom, such as oxygen, nitrogen, sulfur, chlorine, fluorine, bromine, or iodine, and/or at least one heterogroup, such as pyridyl, furyl, thienyl, and imidazolyl. Alternatively, or in addition to including heteroatoms and heterogroups, each hydrocarbyl group designated by $R^{17}$ may independently include at least one substituent group selected from alkoxy, amide, amine, carboxyl, epoxy, ester, ether, hydroxyl, keto, metal salt, sulfuryl, and thiol groups. Alternatively, each hydrocarbyl group designated by $R^{17}$ may be independently unsubstituted.

Exemplary alkyl groups include methyl, ethyl, propyl, isopropyl, n-butyl, isobutyl, sec-butyl, tert-butyl, pentyl, iso-amyl, hexyl, 2-ethylhexyl, octyl and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

The monomeric acyclic amine compound includes monoamines and polyamines (including two or more amine groups). In certain embodiments, at least one group designated by $R^{17}$ is unsubstituted. Alternatively, two or three groups designated by $R^{17}$ are unsubstituted. Alternatively still, it is contemplated that one, two, or three groups designated by $R^{17}$ are substituted.

Exemplary monomeric acyclic amine compounds include, but are not limited to, primary, secondary, and tertiary amines, such as:

methylamine:

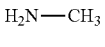

ethanolamine:

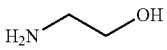

dimethylamine:

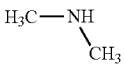

methylethanolamine:

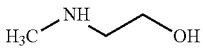

trimethylamine:

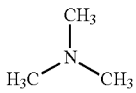

-continued bis (2-ethylhexyl) amine:

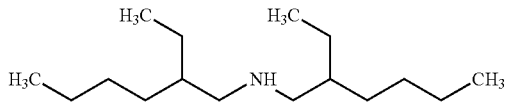

ditridecylamine:

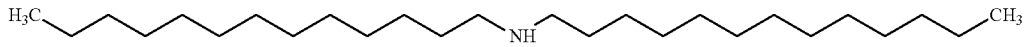

The monomeric acyclic amine compound may alternatively include at least one primary amines such as ethylamine, n-propylamine, isopropylamine, n-butylamine, isobutylamine, sec-butylamine, tert-butylamine, pentylamine, and hexylamine; primary amines of the formulas: $CH_3—O—C_2H_4—NH_2$, $C_2H_5—O—C_2H_4—NH_2$, $CH_3—O—C_3H_6—NH_2$, $C_2H_5—O—C_3H_6—NH_2$, $C_4H_9—O—C_4H_8—NH_2$, $HO—C_2H_4—NH_2$, $HO—C_3H_6—NH_2$ and $HO—C_4H_8—NH_2$; secondary amines, for example diethylamine, methylethylamine, di-n-propylamine, diisopropylamine, diisobutylamine, di-sec-butylamine, di-tert-butylamine, dipentylamine, dihexylamine; and also secondary amines of the formulas: $(CH_3—O—C_2H_4)_2NH$, $(C_2H_5—O—C_2H_4)_2NH$, $(CH_3—O—C_3H_6)_2NH$, $(C_2H_5—O—C_3H_6)_2NH$, $(n\text{-}C_4H_9—O—C_4H_8)_2NH$, $(HO—C_2H_4)_2NH$, $(HO—C_3H_6)_2NH$ and $(HO—C_4H_8)_2NH$; and polyamines, such as n-propylenediamine, 1,4-butanediamine, 1,6-hexanediamine, diethylenetriamine, triethylenetetramine and tetraethylenepentamines, and also their alkylation products, for example 3-(dimethylamino)-n-propylamine, N,N-dimethylethylenediamine, N,N-diethylethylenediamine, and N,N,N',N'-tetramethyldiethylenetriamine.

Alternatively, the amine compound may be a monomeric cyclic amine compound. The monomeric cyclic amine compound may have a weight average molecular weight of from 100 to 1200, 200 to 800, or 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

The monomeric cyclic amine compound may be exemplified by the general formula (XV):

(XV)

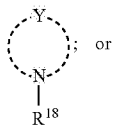

; or general formula (XVI):

(XVI)

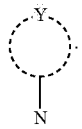

In general formulas (XV) and (XVI), Y represents the type and number of atoms necessary to complete the cyclic ring of general formulas (XV) or (XVI). The ring designated by Y may include from 2 to 20, 3 to 15, 5 to 15, or 5 to 10, carbon atoms. The ring designated by Y may be a substituted or unsubstituted, branched or unbranched, divalent hydrocarbon group that includes at least one hetero atom, such as oxygen, or sulfur, and may include at least one heterogroup. In addition to including heteroatoms and/or heterogroups, the ring designated by Y may include at least one hydrocarbyl substituent group, as described above with respect to $R^1$ in general formula (III). In certain embodiments, the ring designated by Y is free from nitrogen heteroatoms, or free from any heteroatoms. The heteroatoms, heterogroups, and/or substituent groups may be bonded to different atoms in the divalent hydrocarbon group designated by Y. The substituent nitrogen atom in general formula (XVI) may be bonded to at least one hydrogen atom, or may be bonded to one or two hydrocarbyl groups.

In formula (XV), $R^{18}$ is a hydrogen atom or a hydrocarbyl group. The hydrocarbyl group designated by $R^{18}$ may have the same meaning as $R^1$ described above with respect to formula (III). For example, $R^{18}$ may be an alcohol group, an amino group, an alkyl group, an amide group, an ether group, or an ester group. $R^{18}$ may have 1 to 50, 1 to 25, 1 to 17, 1 to 15, 1 to 12, 1 to 8, 1 to 6, or 1 to 4, carbon atoms. $R^{18}$ may be straight or branched. For example, each $R^{18}$ may be an alcohol group, amino group, alkyl group, amide group, ether group, or ester group having 1 to 50 carbon atoms, with the designated functional group (alcohol, etc.), heteroatom, or heterogroup bonded at various positions on the carbon atoms in the backbone. The substituent nitrogen atom in general formula (XVI) may be bonded to at least one hydrogen atom, or may be bonded to one or two hydrocarbyl groups, such as those described above with respect to $R^{18}$.

In one embodiment, the monomeric cyclic amine compound may be exemplified by general formula (XVII):

(XVII)

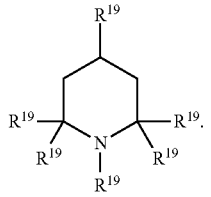

In general formula (XVII), each $R^{19}$ is independently a hydrogen atom or a hydrocarbyl group having from 1 to 17 carbon atoms. The hydrocarbyl group designated by $R^{19}$ may have the same meaning as $R^1$ in general formula (III). For example, each $R^{19}$ may independently be substituted with an alcohol group, an amino group, an amide group, an ether group, or an ester group. Each $R^{19}$ may independently have from 1 to 17, 1 to 15, 1 to 12, 1 to 8, 1 to 6, or 1 to 4, carbon atoms. In certain embodiments, at least one group designated by $R^{19}$ is unsubstituted. Alternatively, at least two, three, four, five, or six groups designated by $R^{19}$ are unsubstituted. Alternatively still, it is contemplated that one, two, three, four, five, or six groups designated by $R^{19}$ are substituted. For example, each $R^{19}$ may be an alcohol group, amino group, alkyl group, amide group, ether group, or ester group having 1 to 17 carbon atoms, with the designated functional group (alcohol, etc) bonded at various positions on the carbon chain.

Exemplary monomeric cyclic amine compounds include:

cyclopentylamine:

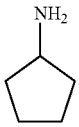

cyclohexylamine:

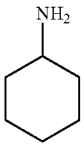

aziridine:

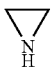

piperidine:

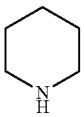

n-methylpiperidine:

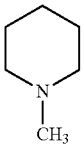

In some embodiments, the amine compound, such as the monomeric acyclic amine compound or the monomeric cyclic amine compound may be a sterically hindered amine compound. The sterically hindered amine compound may have a weight average molecular weight of from 100 to 1200. Alternatively, the sterically hindered amine compound may have a weight average molecular weight of from 200 to 800, or 200 to 600. Alternatively still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. In other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiary nitrogen atom.

The sterically hindered amine compound may have general formula (XVIII) or (XIX):

(XVIII)

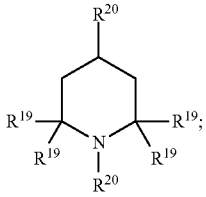

(XIX)

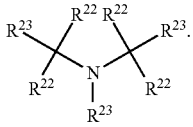

In general formula (XVIII), each $R^{20}$ is independently a hydrogen atom or a hydrocarbyl group having from 1 to 17 carbon atoms, wherein at least two of $R^{20}$ are an alkyl group in one molecule; and $R^{21}$ is independently a hydrogen atom or a hydrocarbyl group having from 1 to 17 carbon atoms. In general formula (XIX), each $R^{22}$ is independently a hydrogen atom or a hydrocarbyl group having from 1 to 17 carbon atoms, wherein at least two of $R^{22}$ are an alkyl group, and each $R^{22}$ is independently a hydrogen atom or a hydrocarbyl group having from 1 to 17 carbon atoms. The groups designated by $R^{20}$, $R^{21}$, $R^{22}$, and $R^{23}$ may have the same meaning as $R^1$ described above with respect to general formula (III). For example, each $R^{20}$, $R^{21}$, $R^{22}$, and $R^{23}$ may independently substituted with an alcohol group, an amide group, an ether group, or an ester group, and each $R^{20}$, $R^{21}$, $R^{22}$, and $R^{23}$ may independently have from 1 to 17, 1 to 15, 1 to 12, 1 to 8, 1 to 6, or 1 to 4, carbon atoms.

In certain embodiments, at least one group designated by $R^{20}$, $R^{21}$, $R^{22}$, and $R^{23}$ is unsubstituted. Alternatively, at least two, three, four, five, or six groups designated by $R^{20}$, $R^{21}$, $R^{22}$, and $R^{23}$ are unsubstituted. In other embodiments, every group designated by $R^{20}$, $R^{21}$, $R^{22}$, and $R^{23}$ is unsubstituted. Alternatively still, it is contemplated that one, two, three, four, five, or six groups designated by $R^{20}$, $R^{21}$, $R^{22}$, and $R^{23}$ are substituted.

Exemplary $R^{20}$, $R^{21}$, $R^{22}$, and $R^{23}$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

In general formula (XVIII), at least two, at least three, or all four groups, designated by $R^{22}$ are each independently an alkyl group. Similarly, in general formula (XIX), at least two groups designated by $R^{22}$ are an alkyl group. Alternatively, at least three, or all four groups, designated by $R^{22}$ are an alkyl group.

The sterically hindered amine compound of general formula (XVIII) may be exemplified by the following compounds:

2,2,6,6-tetramethyl-4-octylpiperdine:

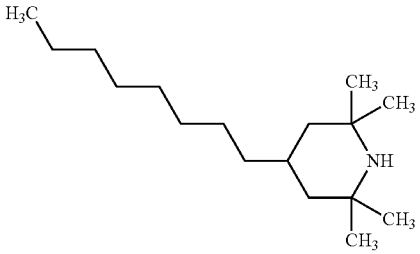

2,2,6,6-tetramethyl-4-decylpiperdine:

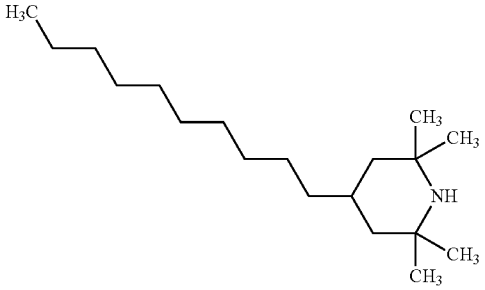

2,2,6,6-tetramethyl-4-decylpiperdine:

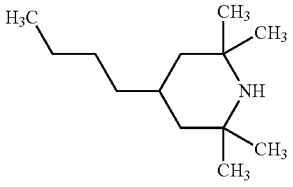

2,2,6,6-tetramethyl-4-hexadecylpiperdine:

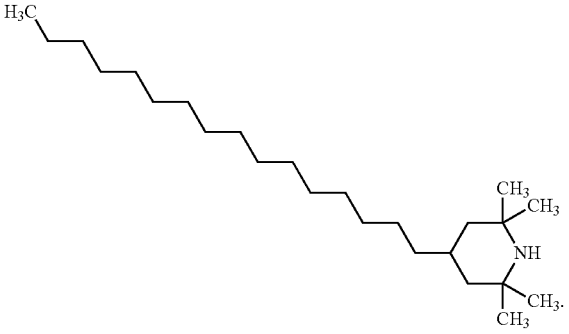

The sterically hindered amine compound of general formula (XIX) is acyclic. The term "acyclic" is intended to mean that the sterically hindered amine compound of general formula (XIX) is free from any cyclic structures and aromatic structures. The sterically hindered amine compound of general formula (XIX) can be exemplified by:

N-tert-butyl-2-ethyl-N-methyl-hexan-1-amine:

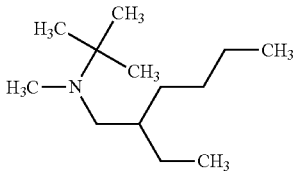

tert-amyl-tert-butylamine:

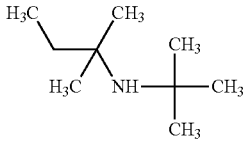

N-tert-butylheptan-2-amine:

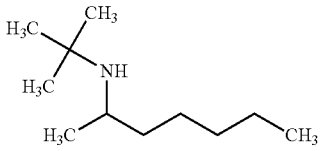

The sterically hindered amine compound may alternatively be exemplified by the general formula (XX):

(XX)

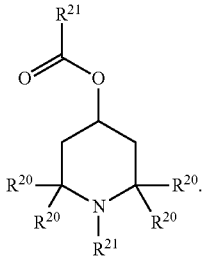

In general formula (XIX), each $R^{20}$ and $R^{21}$ are as described above, wherein at least three of $R^{20}$ are each independently an alkyl group. The sterically hindered amine compound of general formula (XX) may be exemplified by the following compounds:

(1,2,2,6,6-pentamethyl-4-piperidyl) octanoate:

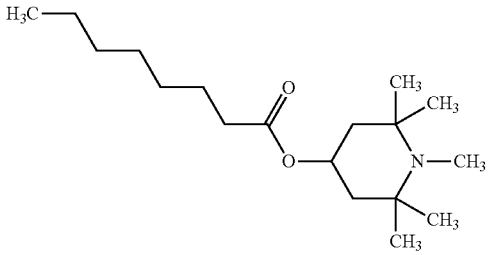

-continued (1,2,2,6,6-pentamethyl-4-piperidyl) decanoate:

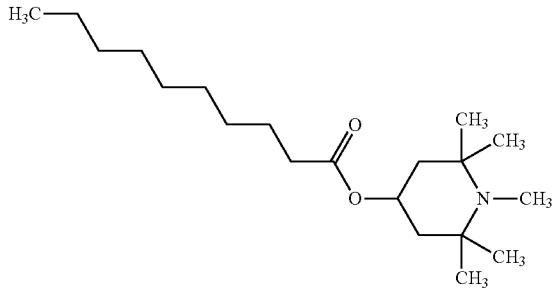

(1,2,2,6,6-pentamethyl-4-piperidyl) dodecanoate:

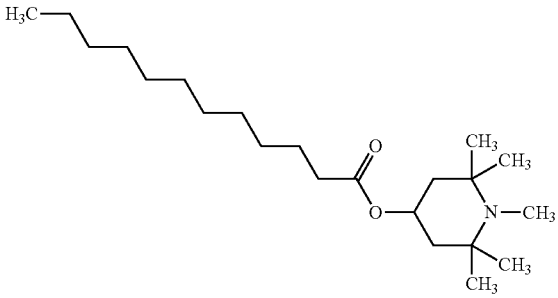

(2,2,6,6-tetramethyl-4-piperidyl) dodecanoate:

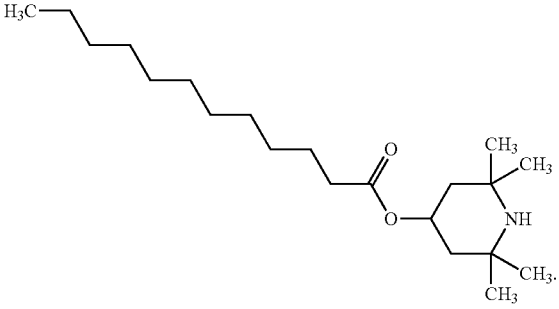

The sterically hindered amine compound may include a single ester group. However, the sterically hindered amine compound may alternatively be free from ester groups. In certain embodiments, the sterically hindered amine compound may include at least one, or only one, piperidine ring.

If utilized, the lubricant composition includes the amine compound such as the sterically hindered amine compound, in an amount of from 0.1 to 25, 0.1 to 20, 0.1 to 15, or 0.1 to 10, wt. %, based on the total weight of the lubricant composition. Alternatively, the lubricant composition may include the amine compound in an amount of from 0.5 to 5, 1 to 3, or 1 to 2, wt. %, based on the total weight of the lubricant composition.

If the amine compound is included in the additive package, the additive package includes the amine compound, such as the sterically hindered amine compound, in an amount of from 0.1 to 50 wt. %, based on the total weight of the additive package. Alternatively, the additive package may include the amine compound in an amount of from 1 to 25, 0.1 to 15, 1 to 10, 0.1 to 8, or 1 to 5, wt. %, based on the total weight of the additive package. Combinations of various amine compounds are also contemplated.

The lubricant composition or the additive package may further include a dispersant in addition to the halide seal compatibility additive, the second seal compatibility additive, and/or the amine compound. The dispersant may be a polyalkene amine or other amine dispersant. As such, depending on the composition of the dispersant, the dispersant may be encompassed by at least one of the descriptions of the amine compound provided above.

The TBN value of the amine dispersant may be least 15, at least 25, or at least 30, mg KOH/g of the amine dispersant. Alternatively, the TBN value of the amine dispersant may range from 15 to 100, from 15 to 80, or from 15 to 75, mg KOH/g of the amine dispersant.

The polyalkene amine includes a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methyl butene, 1-hexene, 2-methylpentene, 3-methylpentene, and 4-methylpentene. The polyalkene moiety has a weight average molecular weight of from 200 to 10000, 500 to 10000, or 800 to 5000.

In one embodiment, the polyalkene amine is derived from polyisobutenes. Particularly suitable polysiobutenes are known as "highly reactive" polyisobutenes which feature a high content of terminal double bonds. Terminal double bonds are alpha-olefinic double bonds of the type shown in general formula (XXI):

(XXI)

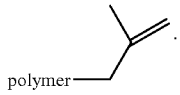

The bonds shown in general formulas (XXI) are known as vinylidene double bones. Suitable highly reactive polypolyisobutenes are, for example, polyisobutenes which have a fraction of vinylidene double bonds of greater than 70, 80, or 85, mole %. Preference is given in particular to polyisobutenes which have uniform polymer frameworks. Uniform polymer frameworks have in particular those polyisobutenes which are composed of at least 85, 90, or 95, wt. %, of isobutene units. Such highly reactive polyisobutenes preferably have a number-average molecular weight in the abovementioned range. In addition, the highly reactive polyisobutenes may have a polydispersity of from 1.05 to 7, or 1.1 to 2.5. The highly reactive polyisobutenes may have a polydispersity less than 1.9, or less than 1.5. Polydispersity refers to the quotients of weight-average molecular weight Mw divided by the number-average molecular weight Mn.

The dispersant may include moieties derived from succinic anhydride and having hydroxyl and/or amino and/or amido and/or imido groups. For example, the dispersant may be derived from polyisobutenylsuccinic anhydride which is obtainable by reacting conventional or highly reactive polyisobutene having a weight average molecular weight of from 500 to 5000 with maleic anhydride by a thermal route or via the chlorinated polyisobutene. For examples, derivatives with aliphatic polyamines such as ethylenediamine, diethylenetriamine, triethylenetetramine or tetraethylenepentamine may be used.

To prepare the polyalkene amine, the polyalkene component may be aminated in a known manner. An exemplary process proceeds via the preparation of an oxo intermediate by hydroformylation and subsequent reductive amination in the presence of a suitable nitrogen compound.

The dispersant may be a poly(oxyalkyl) radical or a polyalkylene polyamine radical of the general formula (XXII):

$$R^{24}—NH—(C_1\text{-}C_6\text{-alkylene-NH})_m—C_1\text{-}C_6\text{-alkylene} \quad (XXII)$$

where m is an integer of from 1 to 5, $R^{24}$ is a hydrogen atom or a hydrocarbyl group having from 1 to 6 carbon atoms with $C_1$-$C_6$ alkylene representing the corresponding bridged analogs of the alkyl radicals. The dispersant may also be a polyalkylene imine radical composed of from 1 to 10 $C_1$-$C_4$ alkylene imine groups; or, together with the nitrogen atom to which they are bonded, are an optionally substituted 5- to 7-membered heterocyclic ring which is optionally substituted by one to three $C_1$-$C_4$ alkyl radicals and optionally bears one further ring heteroatom such as oxygen or nitrogen.

Examples of suitable alkenyl radicals include mono- or polyunsaturated, preferably mono- or diunsaturated analogs of alkyl radicals has from 2 to 18 carbon atoms, in which the double bonds may be in any position in the hydrocarbon chain. Examples of $C_4$-$C_{18}$ cycloalkyl radical include cyclobutyl, cyclopentyl and cyclohexyl, and also the analogs thereof substituted by 1 to 3 $C_1$-$C_4$ alkyl radicals. The $C_1$-$C_4$ alkyl radicals are, for example, selected from methyl, ethyl, iso- or n-propyl, n-, iso-, sec- or tert-butyl. Examples of the arylalkyl radical include a $C_1$-$C_{18}$ alkyl group and an aryl group which are derived from a monocyclic or bicyclic fused or nonfused 4- to 7-membered, in particular 6 membered, aromatic or heteroaromatic group, such as phenyl, pyridyl, naphthyl and biphenyl.

If additional dispersants other than the dispersant described above are employed, these dispersants can be of various types. Suitable examples of dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof.

If employed, the dispersant can be used in various amounts. The dispersant may be present in the lubricant composition in an amount of from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, each based on the total weight of the lubricant composition. The amounts may be in addition to the amounts of the amine compound utilized in the lubricant composition and/or the additive package.

In the additive package, the total weight of the dispersant is less than 50, less than 45, less than 40, less than 35, less than 30, or less than 25, wt. %, of the additive package based on the total weight of the additive package.

The additive package may include the total weight of halide seal compatibility additive and the second seal compatibility additive, with the amine compound in a weight ratio ranging from 1:100 to 10:1, from 1:80 to 2:1; from 1:50 to 10:1, or from 1:10 to 10:1. Alternatively, the additive package the total weight of halide seal compatibility additive and the second seal compatibility additive with the amine compound in a weight ratio ranging from 1:3 to 1:6.

The additive package may consist, or consist essentially of, the halide seal compatibility additive, the second seal compatibility additive, and the amine compound. It is also contemplated that the additive package may consist of, or consist essentially of, the halide seal compatibility additive, the second seal compatibility additive, and the amine compound, in addition to one or more of additives that do not compromise the functionality or performance of the halide seal compatibility additive, the second seal compatibility additive, or the amine compound. In other embodiments, the terminology "consisting essentially of" describes the additive package as being free of compounds that materially affect the overall performance of the additive package as recognized by one of ordinary skill in the art. For example, compounds that materially affect the overall performance of the additive package may be described by compounds which negatively impact the TBN boost, the lubricity, the fluoropolymer seal compatibility, the corrosion inhibition, or the acidity of the lubricant composition formed from the additive package.

The lubricant composition may include a base oil. The base oil is classified in accordance with the American Petroleum Institute (API) Base Oil Interchangeability Guidelines. In other words, the base oil may be further described as one or more of five types of base oils: Group I (sulphur content>0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

In some embodiments, the base oil is selected from the group of API Group I base oils; API Group II base oils; API Group III base oils; API Group IV base oils; API Group V base oils; and combinations thereof. In one embodiment, the base oil includes API Group II base oils.

The base oil may have a viscosity of from 1 to 50, 1 to 40, 1 to 30, 1 to 25, or 1 to 20, cSt, when tested according to ASTM D445 at 100° C. Alternatively, the viscosity of the base oil may range from 3 to 17, or 5 to 14, cSt, when tested according to ASTM D445 at 100° C.

The base oil may be further defined as a crankcase lubricant oil for spark-ignited and compression-ignited internal combustion engines, including automobile and truck engines, two-cycle engines, aviation piston engines, marine engines, and railroad diesel engines. Alternatively, the base oil can be further defined as an oil to be used in gas engines, diesel engines, stationary power engines, and turbines. The base oil may be further defined as heavy or light duty engine oil.

In still other embodiments, the base oil may be further defined as synthetic oil that includes one or more alkylene oxide polymers and interpolymers, and derivatives thereof. The terminal hydroxyl groups of the alkylene oxide polymers may be modified by esterification, etherification, or similar reactions. Typically, these synthetic oils are prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having a weight average molecular weight of 1000; diphenyl ether of polyethylene glycol having a molecular weight of 500-1000; or diethyl ether of polypropylene glycol having a weight average molecular weight of 1,000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil. Alternatively, the base oil may include a substantially inert, normally liquid, organic diluent, such as mineral oil, naptha, benzene, toluene, or xylene.

The base oil may include less than 90, less than 80, less than 70, less than 60, less than 50, less than 40, less than 30, less than 20, less than 10, less than 5, less than 3, less than 1, or be free from, an estolide compound (i.e., a compound including one or more estolide groups), based on the total weight of the lubricant composition.

The base oil may be present in the lubricant composition in an amount of from 1 to 99.9, 50 to 99.9, 60 to 99.9, 70 to 99.9, 80 to 99.9, 90 to 99.9, 75 to 95, 80 to 90, or 85 to 95, wt. %, based on the total weight of the lubricant composition. Alternatively, the base oil may be present in the lubricant composition in amounts of greater than 1, 10, 20, 30, 40, 50, 60, 70, 75, 80, 85, 90, 95, 98, or 99, wt. %, based on the total weight of the lubricant composition. In various embodiments, the amount of base oil in a fully formulated lubricant composition (including diluents or carrier oils present) ranges from 50 to 99, 60 to 90, 80 to 99.5, 85 to 96, or 90 to 95, wt. %, based on the total weight of the lubricant composition. Alternatively, the base oil may be present in the lubricant composition in an amount of from 0.1 to 50, 1 to 25, or 1 to 15, wt. %, based on the total weight of the lubricant composition. In various embodiments, the amount of base oil in an additive package, if included, (including diluents or carrier oils present) ranges from 0.1 to 50, 1 to 25, or 1 to 15, wt. %, based on the total weight of the additive package.

The lubricant composition may have a sulfur content of less than about 0.4 wt. %, less than about 0.35 wt. % or less than about 0.03 wt. %, such as less than about 0.20 wt. %. The Noack volatility (ASTM D5880) of the lubricant composition (oil of lubricating viscosity plus all additives and additive diluent) may be no greater than 13, such as no greater than 12, or alternatively, no greater than 10.

It may be desirable, although not essential to prepare one or more additive packages comprising additives (the additive packages may also be referred to as additive concentrates) whereby several additives can be added simultaneously to the oil to form the lubricant composition.

In one or more embodiments, the lubricant composition may be classified as a low SAPS lubricant having a sulfated ash content of no more than 3, 2, 1, 1.1, 0.8, or 0.5, wt. %, based on the total weight of the lubricant composition. "SAPS" refers to sulfated ash, phosphorous and sulfur.

The lubricant composition may have a TBN value of at least 1, at least 3, at least 5, at least 7, at least 9, mg KOH/g of lubricant composition, when tested according to ASTM D2896. Alternatively, the lubricant composition has a TBN value of from 3 to 100, 3 to 75, 50 to 90, 3 to 45, 3 to 35, 3 to 25, 3 to 15, 6 to 15, or 9 to 12, mg KOH/g of lubricant composition, when tested according to ASTM D2896.

In certain embodiments, the lubricant composition derives at least 5%, at least 10%, or at least 20% of the compositional TBN (as measured in accordance with ASTM D4739) from ashless TBN sources including the at least one amine compound. Alternatively, lubricant composition derives at least 5%, at least 10%, or at least 20% of the compositional TBN from at least one amine compound. In certain embodiments, the lubricant composition contains an amount of the amine compound that contributes from about 0.5 to about 4 mg KOH/g, or from about 1 to about 3 mg KOH/g of TBN (ASTM D4739) to the lubricant composition.

In certain embodiments, the lubricant composition is a multigrade lubricant composition identified by the viscometric descriptor SAE15WT, SAE 10WT, SAE 5WT or SAE 0WT, where T is 8, 12, 16, 20, 30, 40, or 50. The characteristics of one or more of the different viscometric grades can be found in the SAE J300 classification.

The lubricant composition may have a phosphorus content of less than 1500, less than 1200, less than 1000, less than 800, less than 600, less than 400, less than 300, less than 200, or less than 100, or 0, ppm, as measured according to the ASTM D5185 standard, or as measured according to the ASTM D4951 standard. The lubricant composition may have a sulfur content of less than 3000, less than 2500, less than 2000, less than 1500, less than 1200, less than 1000, less than 700, less than 500, less than 300, or less than 100, ppm, as measured according to the ASTM D5185 standard, or as measured according to the ASTM D4951 standard.

The final lubricant composition may employ from 5 to 25 wt. %, alternatively 5 to 18 wt. %, or 10 to 15 wt. % of the additive package, the remainder being oil of lubricating viscosity and viscosity modifier. In certain embodiments, the additive package includes the base oil. If included, the additive package includes the base oil in an amount ranging from 0.1 to 50, from 1 to 25, or from 1 to 15, wt. %, based on the total weight of the additive package.

The lubricant composition may be free from, or substantially free from, a carboxylic acid ester and/or phosphate ester. For example, the lubricant composition may include less than 20, less than 15, less than 10, less than 5, less than 3, less than 1, less than 0.5, or less than 0.1, wt. %, carboxylic acid ester and/or phosphate ester. The carboxylic acid ester and/or phosphate ester may be included as conventional base oil in water-reactive functional fluids. The lubricant composition may be free from a carboxylic acid ester base oil and/or phosphate ester base oil, which are liquid at a steady state temperature of 25° C. and a steady state pressure of 1 atmosphere.

In certain embodiments, the present disclosure provides lubricant compositions, having crankcase lubricant compositions for heavy duty diesel (HDD) engines, containing the containing the seal compatibility additive and one or more amines compounds useful as additives for increasing the TBN of lubricant compositions without introducing sulfated ash.

In certain embodiments, the present disclosure provides lubricant compositions meeting the performance criteria of one or more of the ACEA E6, MB p228.51, API C)-4+ and API CJ-4 specifications for heavy duty engine lubricants.

In certain embodiments, the present disclosure provides a heavy duty diesel engine equipped with an exhaust gas recirculation (EGR) system (for example, a condensed EGR system and a particulate trap) the crankcase of which engine is lubricated with a lubricant composition.

In certain embodiments, the present disclosure provides a method for forming a high TBN lubricant composition having a reduced SASH content comprising incorporating into a lubricant composition one or more amine compounds useful as additives for increasing the TBN of lubricant compositions without introducing sulfated ash and incorporating the seal compatibility additive.

The lubricant composition may be unreactive with water. By unreactive with water, it is meant that less than 5, 4, 3, 2, 1, 0.5, or 0.1, wt., %, of the lubricant composition reacts with water at 1 atmosphere of pressure and 25° C.

In various embodiments, the lubricant composition is substantially free of water, e.g., the lubricant composition includes less than 5, less than 4, less than 3, less than 2, less than 1, less than 0.5, or less than 0.1, wt. %, of water, based on the total weight of the lubricant composition. Alternatively, the lubricant composition may be completely free of water.

The lubricant composition may be a lubricant composition, such as a crankcase lubricant composition, having a total additive treat rate of at least 3, at least 4, at least 5, at least 6, at least 7, or at least 8, wt. %, based on a total weight of the lubricant composition. Alternatively, the lubricant composition may have a total additive treat rate ranging from 3 to 20, 4 to 18, 5 to 16, or 6 to 14, wt. %, based on a total weight of the lubricant composition. The term "total additive treat rate" refers to the total weight percentage of additives included in the lubricant composition. The additives accounted for in the total additive treat rate include, but are not limited to, seal compatibility additives, including the halide seal compatibility additive and the second seal compatibility additive (i.e., epoxide compounds, halogen compounds, and/or boroxine compounds), amine compounds, dispersants, detergents, aminic antioxidants, phenolic antioxidants, anti-foam additives, antiwear additives, pour point depressants, viscosity modifiers, and combinations thereof. In certain embodiments, an additive is any compound in the lubricant composition other than the base oil. In other words, the total additive treat rate calculation does not account for the base oil as an additive.

The additive package may include, but is not limited to, seal compatibility additives, such as the halide seal compatibility additive and the second seal compatibility additive (i.e., epoxide compounds, halogen compounds, and/or boroxine compounds), amine compounds, dispersants, detergents, aminic antioxidants, phenolic antioxidants, anti-foam additives, antiwear additives, pour point depressants, viscosity modifiers, and combinations thereof. The lubricant composition may include the additive package in amount of at least 3, at least 4, at least 5, at least 6, at least 7, or at least 8, wt. %, based on a total weight of the lubricant composition. Alternatively, the lubricant composition may include the additive package in an amount of from 3 to 20, 4 to 18, 5 to 16, or 6 to 14, wt. %, based on a total weight of the lubricant composition. In some embodiments, the additive package does not account for the weight of the base oil as an additive. Although not required, the additive package includes all compounds in the lubricant composition other than the base oil. However, it is to be appreciated that certain individual components can be independently and individually added to the lubricant composition separate from the addition of the additive package to the lubricant composition, yet still be considered part of the additive package once the additive which was individually added into the lubricant composition is present in the lubricant composition along with the other additives.

The additive package refers to the collective amount of the seal compatibility additives, such as the halide seal compatibility additives and the second seal compatibility additive, amine compounds, dispersants, detergents, aminic antioxidants, phenolic antioxidants, anti-foam additives, antiwear additives, pour point depressants, viscosity modifiers, or combinations thereof in a solution, mixture, concentrate, or blend, such as the lubricant composition. In some embodiments, the term "additive package" does not require that these additives are physically packaged together or blended together before addition to the base oil. Thus, the base oil which includes the seal compatibility additive and the dispersant, each added to the base oil separately, could be interpreted to be a lubricant composition that includes an additive package comprising the seal compatibility additive and the dispersant. In other embodiments, the additive package refers to a blend of the seal compatibility additives, amine compounds, dispersants, detergents, aminic antioxidants, phenolic antioxidants, anti-foam additives, antiwear additives, pour point depressants, viscosity modifiers, or combinations thereof. The additive package may be blended into the base oil to make the lubricant composition.

The additive package may be formulated to provide the desired concentration in the lubricant composition when the additive package is combined with a predetermined amount of base oil. It is to be appreciated that most references to the lubricant composition throughout this disclosure also apply to the description of the additive package. For example, it is to be appreciated that the additive package may include, or exclude, the same components as the lubricant composition, albeit in different amounts.

In one embodiment, the lubricant composition passes ASTM D4951 for phosphorus content. ASTM D4951 is a standard test method for determination of additive elements in lubricant compositions by inductively coupled plasma atomic emission spectrometry (ICP-OES).

In another embodiment, the lubricant composition passes ASTM D6795, which is a standard test method for measuring the effect on filterability of lubricant compositions after treatment with water and dry ice and a short (30 min) heating time. ASTM D6795 simulates a problem that may be encountered in a new engine run for a short period of time, followed by a long period of storage with some water in the oil. ASTM D6795 is designed to determine the tendency of a lubricant composition to form a precipitate that can plug an oil filter.

In another embodiment, the lubricant composition passes ASTM D6794, which is a standard test method for measuring the effect on filterability of lubricant composition after treatment with various amounts of water and a long (6 h) heating time. ASTM D6794 simulates a problem that may be encountered in a new engine run for a short period of time, followed by a long period of storage with some water in the oil. ASTM D6794 is also designed to determine the tendency of the lubricant composition to form a precipitate that can plug an oil filter.

In another embodiment, the lubricant composition passes ASTM D6922, which is a standard test method for determining homogeneity and miscibility in lubricant compositions. ASTM D6922 is designed to determine if a lubricant composition is homogeneous and will remain so, and if the lubricant composition is miscible with certain standard reference oils after being submitted to a prescribed cycle of temperature changes.

In another embodiment, the lubricant composition passes ASTM D5133, which is a standard test method for low temperature, low shear rate, viscosity/temperature dependence of lubricating oils using a temperature-scanning technique. The low-temperature, low-shear viscometric behavior of a lubricant composition determines whether the lubricant composition will flow to a sump inlet screen, then to an oil pump, then to sites in an engine requiring lubrication in sufficient quantity to prevent engine damage immediately or ultimately after cold temperature starting.

In another embodiment, the lubricant composition passes ASTM D5800 and/or ASTM D6417, both of which are test methods for determining an evaporation loss of a lubricant composition. The evaporation loss is of particular importance in engine lubrication, because where high temperatures occur, portions of a lubricant composition can evaporate and thus alter the properties of the lubricant composition.

In another embodiment, the lubricant composition passes ASTM D6557, which is a standard test method for evaluation of rust preventive characteristics of lubricant compositions. ASTM D6577 includes a Ball Rust Test (BRT) procedure for evaluating the anti-rust ability of lubricant compositions. This BRT procedure is particularly suitable for the evaluation of lubricant compositions under low-temperature and acidic service conditions.

In another embodiment, the lubricant composition passes ASTM D4951 for sulfur content. ASTM D4951 is a standard test method for determination of additive elements in lubricant compositions by ICP-OES. In addition, the lubricant composition also passes ASTM D2622, which is a standard test method for sulfur in petroleum products by wavelength dispersive x-ray fluorescence spectrometry.

In another embodiment, the lubricant composition passes ASTM D6891, which is a standard test method for evaluating a lubricant composition in a sequence IVA spark-ignition engine. ASTM D6891 is designed to simulate extended engine idling vehicle operation. Specifically, ASTM D6891 measures the ability of a lubricant composition to control camshaft lobe wear for spark-ignition engines equipped with an overhead valve-train and sliding cam followers.

In another embodiment, the lubricant composition passes ASTM D6593, which is a standard test method for evaluating lubricant compositions for inhibition of deposit formation in a spark-ignition internal combustion engine fueled with gasoline and operated under low-temperature, light-duty conditions. ASTM D6593 is designed to evaluate a lubricant composition's control of engine deposits under operating conditions deliberately selected to accelerate deposit formation.

In another embodiment, the lubricant composition passes ASTM D6709, which is a standard test method for evaluating lubricant compositions in a sequence VIII spark-ignition engine. ASTM D6709 is designed to evaluate lubricant compositions for protection of engines against bearing weight loss.

In yet another embodiment, the lubricant composition passes ASTM D6984—the standard test method for evaluation of automotive engine oils in the Sequence IIIF, Spark-Ignition. In other words, the viscosity increase of the lubricant composition at the end of the test is less than 275% relative to the viscosity of the lubricant composition at the beginning of the test.

In another embodiment, the lubricant composition passes two, three, four, or more of the following standard test methods: ASTM D4951, ASTM D6795, ASTM D6794, ASTM D6922, ASTM D5133, ASTM D6557, ASTM D6891, ASTM D2622, ASTM D6593, and ASTM D6709.

The lubricant composition or the additive package may further include an antiwear additive, the anti-wear additive optionally comprising phosphorous. The antiwear additive may include sulfur- and/or phosphorus- and/or halogen-containing compounds, e.g., sulfurised olefins and vegetable oils, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof, diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis (2-ethylhexyl) aminomethyl]-2-mercapto-1H-1,3-benzothiazole, ethoxycarbonyl-5-octyldithio carbamate, and/or combinations thereof.

In some embodiments, the antiwear additive may be exemplified by a dihydrocarbyl dithiophosphate salt. The dihydrocarbyl dithiophosphate salt may be represented by the following general formula (XXIII):

$$[R^{25}O(R^{26}O)PS(S)]_2M \quad \text{(XXIII)}$$

where $R^{25}$ and $R^{26}$ are each hydrocarbyl groups independently having from 1 to 30, 1 to 20, 1 to 15, 1 to 10, or 1 to 5, carbon atoms, wherein M is a metal atom or an ammonium group. For example, $R^{25}$ and $R^{26}$ may each independently be $C_{1-20}$ alkyl groups, $C_{2-20}$ alkenyl groups, $C_{3-20}$ cycloalkyl groups, $C_{1-20}$ aralkyl groups or $C_{3-20}$ aryl groups. The groups designated by $R^{25}$ and $R^{26}$ may be substituted or unsubstituted. The hydrocarbyl groups designated by $R^{25}$ and $R^{26}$ groups may have the same meaning as described above with respect to $R^1$ in general formula III. The metal atom may be selected from the group including aluminum, lead, tin, manganese, cobalt, nickel, or zinc. The ammonium group may be derived from ammonia or a primary, secondary, or tertiary amine. The ammonium group may be of the formula $R^{25}R^{26}R^{27}R^{28}N^+$, wherein $R^{27}$, $R^{28}$, $R^{29}$, and $R^{30}$ each independently represents a hydrogen atom or a hydrocarbyl group having from 1 to 150 carbon atoms. In certain embodiments, $R^{27}$, $R^{28}$, $R^{29}$, and $R^{30}$ may each independently be hydrocarbyl groups having from 4 to 30 carbon atoms. The hydrocarbyl groups designated by $R^{27}$, $R^{28}$, $R^{29}$, and $R^{30}$ may have the same meaning and $R^1$ in general formula III. In one embodiment, the dihydrocarbyl dithiophosphate salt is zinc dialkyl dithiophosphate. The lubricant composition may include mixtures of different dihydrocarbyl dithiophosphate salts.

In certain embodiments, the dihydrocarbyl dithiophosphate salt includes a mixture of primary and secondary alkyl groups for, $R^{25}$ and $R^{26}$, wherein the secondary alkyl groups are in a major molar proportion, such as at least 60, at least 75, or at least 85, mole %, based on the number of moles of alkyl groups in the dihydrocarbyl dithiophosphate salt.

In some embodiments, the antiwear additive may be ashless. The antiwear additive may be further defined as a phosphate. In another embodiment, the antiwear additive is further defined as a phosphite. In still another embodiment, the antiwear additive is further defined as a phosphorothionate. The antiwear additive may alternatively be further defined as a phosphorodithioate. In one embodiment, the antiwear additive is further defined as a dithiophosphate. The antiwear additive may also include an amine such as a secondary or tertiary amine. In one embodiment, the antiwear additive includes an alkyl and/or dialkyl amine. Structures of suitable non-limiting examples of antiwear additives are set forth immediately below:

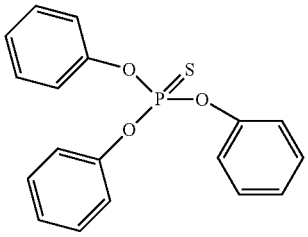

Triphenyl Phosphorothionate

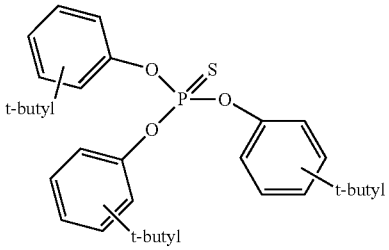

Butylated Triphenyl Phosphorothionate

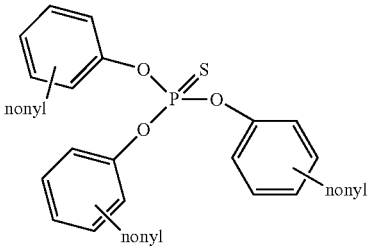

Nonyl Triphenyl Phosphorothionate

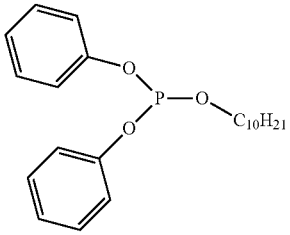

Decyl Diphenylphosphite

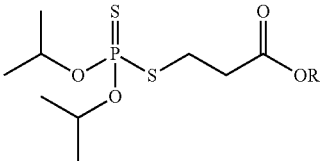

Neutral Dialkyl Dithiophosphate

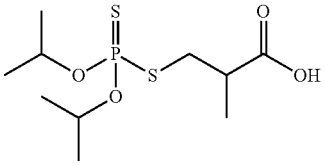

Acidic Dialkyl Dithiophosphate

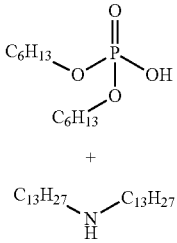

Amine Phophate + Ditridecyl Amine

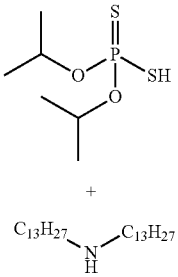

Isopropyl Phosphorodithioate + Ditridecyl Amine

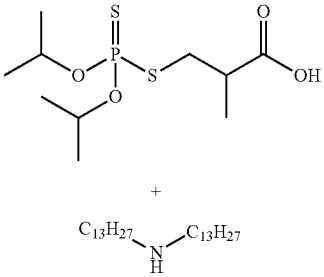

Acidic Dialkyl Dithiophosphate + Ditridecyl Amine

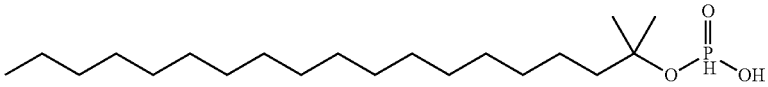

Dimethyloctadecyl Phosphonate

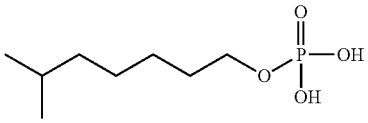

Iso-Octyl Phosphate + $C_{12}$-$C_{14}$ Amine

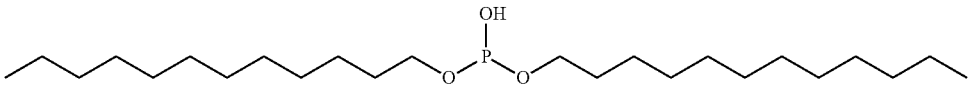

Dilauryl Hydrogen Phosphite

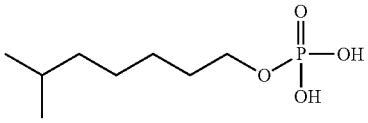

Iso-Octyl Phosphate + $C_{12}$-$C_{14}$ Amine

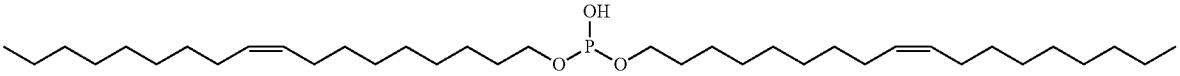

Dioleyl Hydrogen Phosphite

-continued

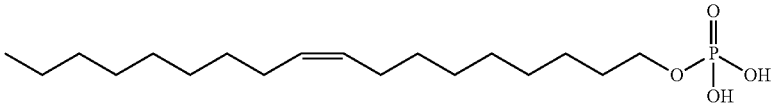

Oleyl Phosphate

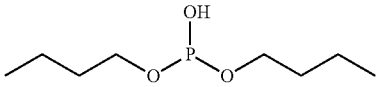

Dibutyl Hydrogen Phosphite

In other embodiments, the anti-wear additive may include molybdenum. For example, the anti-wear additive including molybdenum may be exemplified by any suitable oil-soluble organo-molybdenum compound. Typically, the anti-wear additive including molybdenum includes a molybdenum-sulfur core formed from one or more molybdenum atoms and one or more sulfur atoms. Non-limiting examples of suitable anti-wear additives including molybdenum include molybdenum dithiocarbamates, molybdenum dithiophosphates, molybdenum dialkyldithiophosphates, molybdenum dithiophosphinates, molybdenum xanthates, molybdenum alkyl xanthates, molybdenum alkylthioxanthates, molybdenum thioxanthates, molybdenum sulfides, and combinations thereof.

In certain embodiments, the anti-wear additive including molybdenum is dinuclear or trinuclear. In one embodiment, the anti-wear additive including molybdenum is a tri-nuclear molybdenum compound that may be represented by the following general formula (XXIV):

$$Mo_3S_kL_nQ \quad \text{(XXIV).}$$

In general formula (XXIV), L is an independently selected ligand having organo groups with a sufficient number of carbon atoms to render the compounds soluble or dispersible in the oil. In general formula (XXIV), n is a number from 1 to 4. Also in general formula (XXIII), k is a number from 4 to 7. Further in general formula (XXIV), Q is selected from the group of neutral electron donating compounds such as water, amines, alcohols, phosphines, and ethers. Also in general formula (XXIV), O is a number from 0 to 5. In certain embodiments, at least 21, at least 25, at least 30, or at least 35, total carbon atoms should be present among all the ligands' organo groups of the anti-wear additive including molybdenum.

In various embodiments, the anti-wear additive of the additive package or the lubricant composition may include phosphorus and molybdenum in a single compound. It is to be appreciated that one or more of the anti-wear additives including phosphorus described above may include phosphorus and molybdenum in a single compound. It is also to be appreciated that one or more of the anti-wear additives including molybdenum described above may include phosphorus and molybdenum in a single compound.

The antiwear additive can be present in the lubricant composition in an amount of from 0.1 to 20, 0.5 to 15, 1 to 10, 0.1 to 5, 0.1 to 1, 0.1 to 0.5, or 0.1 to 1.5, wt. %, each based on the total weight of the lubricant composition. Alternatively, the antiwear additive may be present in amounts of less than 20, less than 10, less than 5, less than 1, less than 0.5, or less than 0.1, wt. %, each based on the total weight of the lubricant composition. The additive package may also include the antiwear additive comprising phosphorous in an amount of from 0.1 to 20, 0.5 to 15, 1 to 10, 0.1 to 5, 0.1 to 1, 0.1 to 0.5, or 0.1 to 1.5, wt. %, each based on the total weight of the additive package.

The lubricant composition or the additive package may additionally include one or more additives to improve various chemical and/or physical properties of the lubricant composition. These additives may be in addition to the seal compatibility additive, in addition to the combination of the halide seal compatibility additive and the second seal compatibility additive, and the antiwear additive. Specific examples of the one or more additives include antioxidants, metal deactivators (or passivators), rust inhibitors, viscosity index improvers, pour point depressors, dispersants, detergents, and antifriction additives. Each of the additives may be used alone or in combination. The one or more additives can be used in various amounts, if employed. The lubricant composition may be formulated with the addition of several auxiliary components to achieve certain performance objectives for use in certain applications. For example, the lubricant composition may be a rust and oxidation lubricant formulation, a hydraulic lubricant formulation, turbine lubricant oil, and an internal combustion engine lubricant formulation. Accordingly, it is contemplated that the base oil may be formulated to achieve these objectives as discussed below.

If employed, the antioxidant can be of various types. Suitable antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate, and combinations thereof, may also be utilized.

Furthermore, hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl) disulfide, and combinations thereof, may also be used.

It is also contemplated that alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercapto butane, ethylene glycol bis[3,3-bis(3'-tert-butyl-4'-hydroxyphenyl)butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O-, N- and S-benzyl compounds, for example 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate, and combinations thereof are also suitable for use as antioxidants.

Triazine compounds, for example 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris(3,5-di-tert-butyl-4-hydroxyphenyl propionyl)-hexahydro-1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example, 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl) phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl3,5-di-tert-butyl-4-hydroxybenzylphosphonate, dioctadecyl-5-tert-butyl-4-hydroxy3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, and octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may also be used. It is further contemplated that esters of β-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl) isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be used.

Additional examples of suitable antioxidants include those that include nitrogen, such as amides of β-(3,5-di-tert-butyl-4-hydroxyphenyl)propionic acid, e.g., N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis (1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino) propane, (o-tolyl)biguanide, bis[4-(1',3'-dimethylbutyl) phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1, 4-benzothiazine, phenothiazine, N-allylphenothiazine, N,N,N',N'-tetraphenyl-1,4-diaminobut-2-ene, and combinations thereof.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiatridecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant may be present in the lubricant composition in an amount of from 0.01 to 5, 0.1 to 3, or 0.5 to 2, wt. %, based on the total weight of the lubricant composition. Alternatively, the antioxidant may be present in amounts of less than 5, less than 3, or less than 2, wt. %, based on the total weight of the lubricant composition.

If employed, the metal deactivator can be of various types. Suitable metal deactivators include benzotriazoles and derivatives thereof, for example 4- or 5 alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl) tolutriazole, and combinations thereof.

Additional examples of suitable metal deactivators include 1,2,4-triazoles and derivatives thereof, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl) imidazol-2-yl]carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator may be present in the lubricant composition in an amount of from 0.01 to 0.1, 0.05 to 0.01, or 0.07 to 0.1, wt. %, based on the total weight of the lubricant composition. Alternatively, the metal deactivator may be present in amounts of less than 1.0, less than 0.7, or less than 0.5, wt. %, based on the total weight of the lubricant composition.

If employed, the rust inhibitor and/or friction modifier can be of various types. Suitable examples of rust inhibitors and/or friction modifiers include organic acids, their esters, metal salts, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy (ethoxy)acetic acid, and also N-oleoylsarcosine, sorbitan monooleate, lead naphthenate, alkenylsuccinic anhydrides, for example, dodecenylsuccinic anhydride, 2-carboxymethyl-1-dodecyl-3-methylglycerol, and combinations thereof. Further examples include heterocyclic compounds, for example: substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, molybdenum-containing compounds, such as molybdenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl) glycerols and 2-carboxyalkyl-1,3-dialkylglycerols, and combinations thereof.

If employed, the rust inhibitor and/or friction modifier can be used in various amounts. The rust inhibitor and/or friction modifier may be present in the lubricant composition in an amount of from 0.01 to 0.1, 0.05 to 0.01, or 0.07 to 0.1, wt. %, based on the total weight of the lubricant composition. Alternatively, the rust inhibitor and/or friction modifier may be present in amounts of less than 1, less than 0.7, or less than 0.5, wt. %, based on the total weight of the lubricant composition.

If employed, the viscosity index improver can be of various types. Suitable examples of viscosity index improvers include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the viscosity index improver can be used in various amounts. The viscosity index improver may be present in the lubricant composition in an amount of from 0.01 to 20, 1 to 15, or 1 to 10, wt. %, based on the total weight of the lubricant composition. Alternatively, the viscosity index improver may be present in amounts of less than 10, less than 8, or less than 5, wt. %, based on the total weight of the lubricant composition.

If employed, the pour point depressant can be of various types. Suitable examples of pour point depressants include polymethacrylate and alkylated naphthalene derivatives, and combinations thereof.

If employed, the pour point depressant can be used in various amounts. The pour point depressant may be present in the lubricant composition in an amount of from 0.01 to 0.1, 0.05 to 0.01, or 0.07 to 0.1, wt. %, each based on the total weight of the lubricant composition. Alternatively, the pour point depressant may be present in amounts of less than 1.0, less than 0.7, or less than 0.5, wt. %, based on the total weight of the lubricant composition.

If employed, the detergent can be of various types. Suitable examples of detergents include overbased or neutral metal sulphonates, phenates and salicylates, and combinations thereof.

If employed, the detergent can be used in various amounts. The detergent may be present in the lubricant composition in an amount of from 0.01 to 5, 0.1 to 4, 0.5 to 3, or 1 to 3, wt. %, based on the total weight of the lubricant composition. Alternatively, the detergent may be present in amounts of less than 5, less than 4, less than 3, less than 2, or less than 1, wt. %, based on the total weight of the lubricant composition.

Preferred lubricant compositions provided for use and used pursuant to this invention include those which pass the CEC L-39-T96 seal compatibility test. The CEC L-39-T96 test involves keeping a test specimen of a fluoropolymer in a lubricant composition at 150° C. The seal specimens are then removed and dried and the properties of the seal specimens are assessed and compared to the seal specimens which were not heated in the lubricant composition. The percent change in these properties is assessed to quantify the compatibility of the fluoropolymer seal with the lubricant composition.

The pass/fail criteria include maximum variation of certain characteristics after immersion for 7 days in fresh oil without pre-aging. The maximum variation for each characteristic depends on the type of elastomer used, the type of engine used, and whether an after-treatment device is utilized.

The characteristics measured before and after immersion included Hardness DIDC (points); Tensile Strength (%); Elongation at Rupture (%); Volume Variation (%). For heavy-duty diesel engines, the pass/fail criteria are presented below in Table 1:

TABLE 1

Fluoropolymer Seal Compatibility for CEC L-39-T96 Heavy-Duty Diesel Engines

| Property | Elastomer Type RE1 |
|---|---|
| Hardness DIDC, points | −1/+5 |
| Tensile Strength, % | −50/+10 |
| Elongation at Rupture, % | −60/+10 |
| Volume Variation, % | −1/+5 |

In these tests, a conventional lubricant composition passes the test if the exposed test specimen exhibits a change in hardness from −1% to +5%; a tensile strength (as compared to an untested specimen) from −50% to +10%; a change in elongation at rupture (as compared to an untested specimen) from −60% to +10%; and a volume variation (as compared to an untested specimen) from −1% to +5%.

Some of the compounds described above may interact in the lubricant composition, so that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

A method of lubricating a system is provided. The method includes contacting the system with the lubricant composition described above. The system may further include an internal combustion engine. Alternatively, the system may further include any combustion engine or application that utilizes a lubricant composition. The system includes at least one fluoropolymer seal.

The method may include providing the lubricant composition to the crankcase of the internal combustion engine, providing a fuel in a combustion chamber of the internal combustion engine, and combusting the fuel in an internal combustion engine.

The fluoropolymer seal may include a fluoroelastomer. The fluoroelastomer may be categorized under ASTM D1418 and ISO 1629 designation of FKM for example. The fluoroelastomer may include copolymers of hexafluoropropylene (HFP) and vinylidene fluoride (VDF of VF2), terpolymers of tetrafluoroethylene (TFE), vinylidene fluoride and hexafluoropropylene, perfluoromethylvinylether (PMVE), copolymers of TFE and propylene and copolymers of TFE, PMVE and ethylene. The fluorine content varies for example between 66 to 70 wt. %, based on the total weight of the fluoropolymer seal. FKM is fluoro-rubber of the polymethylene type having substituent fluoro and perfluoroalkyl or perfluoroalkoxy groups on the polymer chain.

In addition, a method of forming the lubricant composition is provided. The method includes combining the base oil, the halide seal compatibility additive, the second seal compatibility additive, and, optionally, the amine compound and/or the antiwear additive. The amine compound and the seal compatibility additives may be incorporated into the base oil in any convenient way. Thus, the amine compound and the seal compatibility additives can be added directly to the base oil by dispersing or dissolving it in the base oil at the desired level of concentration. Alternatively, the base oil may be added directly to the amine compound and the seal compatibility additives in conjunction with agitation until the amine compound and the seal compatibility additives are provided at the desired level of concentration. Such blending may occur at ambient or lower temperatures, such as 30, 25, 20, 15, 10, or 5° C.

A method of improving seal compatibility is also contemplated. The method of improving seal compatibility of a lubricant composition may include employing the halide seal compatibility additive and/or the second seal compatibility additive in a lubricant composition to improve the seal compatibility of the lubricant composition.

Many modifications and variations of the present disclosure are possible in light of the above teachings, and the disclosure may be practiced otherwise than as specifically described within the scope of the appended claims. The subject matter of all combinations of independent and dependent claims, both single and multiple dependent, is herein expressly contemplated. It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

What is claimed is:

1. An additive package for a lubricant composition that provides improved compatibility with fluoropolymer seals, said additive package comprising:

an iodide seal compatibility additive comprising at least one iodine atom; and a second seal compatibility additive, different from said iodide seal compatibility additive, wherein a weight of said second seal compatibility additive in said additive package is greater than or equal to a weight of said iodide seal compatibility additive in said additive package, wherein said iodide seal compatibility additive comprises:

(1) an acyclic hydrocarbon backbone comprising at least one carbon atom, and wherein said at least one iodine atom is bonded to said at least one carbon atom in said acyclic hydrocarbon backbone and wherein said acyclic hydrocarbon backbone includes at least one hydroxyl group; or (2) an alkyl iodide compound having a general formula:

$$C_nH_{(2n+2-m)}I_m$$

where $n \geq 1$, and $1 \leq m \leq (2n+2)$.

2. The additive package of claim 1 wherein said iodide seal compatibility additive comprises said alkyl iodide compound and comprises iodododecane.

3. The additive package of claim 1 wherein said iodide seal compatibility additive has a boiling point of from 150 to 450° C. at 1 atmosphere.

4. The additive package of claim 1 wherein said second seal compatibility additive comprises at least one halogen atom selected from the group consisting of fluorine, bromine, and combinations thereof.

5. The additive package of claim 4 wherein said second seal compatibility additive comprises an acyclic hydrocarbon backbone comprising at least one carbon atom, and wherein said at least one halogen atom is bonded to said at least one carbon atom in said acyclic hydrocarbon backbone.

6. The additive package of claim 5 wherein said second seal compatibility additive is an alkyl halide compound having a general formula:

$$C_nH_{(2n+2-m)}X_m$$

where $n \geq 1$, $1 \leq m \leq (2n+2)$, and X is selected from the group consisting of fluorine, bromine, and combinations thereof.

7. The additive package of claim 1 wherein said second seal compatibility additive comprises a boroxine compound, an epoxide compound, a sulfonate ester, or combinations thereof.

8. The additive package of claim 1 wherein the weight of said second seal compatibility additive in said additive package is at least 25% greater than the weight of said iodide seal compatibility additive in said additive package.

9. The additive package of claim 1 further comprising an amine compound.

10. The additive package of claim 9 wherein said amine compound comprises a sterically hindered amine compound.

11. The additive package of claim 9 wherein said amine compound comprises a sterically hindered amine compound having a general formula (XX):

(XX)

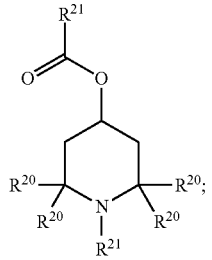

wherein each $R^{20}$ is independently a hydrogen atom or a hydrocarbyl group having from 1 to 17 carbon atoms;

wherein at least two groups designated by $R^{20}$ are an alkyl group; and wherein each $R^{21}$ is independently a hydrogen atom or a hydrocarbyl group having from 1 to 17 carbon atoms.

12. The additive package of claim 9 wherein said amine compound comprises an amine dispersant.

13. The additive package of claim 9 further comprising an anti-wear additive.

14. A lubricant composition that provides improved compatibility with fluoropolymer seals, said lubricant composition comprising:

a base oil;

an iodide seal compatibility additive comprising at least one iodine atom; and a second seal compatibility additive, different from said iodide seal compatibility additive, wherein a weight of said second seal compatibility additive in said lubricant composition is greater than or equal to a weight of said iodide seal compatibility additive in said additive lubricant composition, wherein said iodide seal compatibility additive comprises:

(1) an acyclic hydrocarbon backbone comprising at least one carbon atom, and wherein said at least one iodine atom is bonded to said at least one carbon atom in said acyclic hydrocarbon backbone and wherein said acyclic hydrocarbon backbone includes at least one hydroxyl group; or (2) an alkyl iodide compound having a general formula:

$$C_nH_{(2n+2-m)}I_m$$

where $n \geq 1$, and $1 \leq m \leq (2n+2)$.

15. The lubricant composition of claim 14 wherein said iodide seal compatibility additive comprises said alkyl iodide compound and comprises iodododecane.

16. The lubricant composition of claim 14, wherein said iodide seal compatibility additive has a boiling point of from 150 to 450° C. at 1 atmosphere.

17. The lubricant composition of claim 14 wherein said second seal compatibility additive comprises at least one halogen atom selected from the group consisting of fluorine, bromine, and combinations thereof.

18. The lubricant composition of claim 17 wherein said second seal compatibility additive comprises an acyclic hydrocarbon backbone comprising at least one carbon atom, and wherein said at least one halogen atom is bonded to said at least one carbon atom in said acyclic hydrocarbon backbone.

19. The lubricant composition of claim 14 wherein said second seal compatibility additive is an alkyl halide compound having a general formula:

$$C_nH_{(2n+2-m)}X_m$$

where $n \geq 1$, $1 \leq m \leq (2n+2)$, and X is selected from the group consisting of fluorine, bromine, and combinations thereof.

20. The lubricant composition of claim 14 wherein said second seal compatibility additive comprises a boroxine compound, an epoxide compound, a sulfonate ester, or combinations thereof.

21. The lubricant composition of claim 14 wherein the weight of said second seal compatibility additive in said lubricant composition is at least 25% greater than the weight of said iodide seal compatibility additive in said lubricant composition.

22. The lubricant composition of claim 14 further comprising an amine compound.

23. The lubricant composition of claim 22 wherein said amine compound is present in an amount ranging from 0.01 to 10 wt. % based on the total weight of said lubricant composition.

24. The lubricant composition of claim 22 wherein said amine compound comprises a sterically hindered amine compound.

25. The lubricant composition of claim 22 wherein said amine compound comprises a sterically hindered amine compound having a general formula (XX):

(XX)

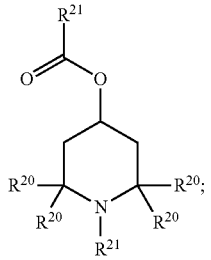

wherein each $R^{20}$ is independently a hydrogen atom or a hydrocarbyl group having from 1 to 17 carbon atoms;

wherein at least two groups designated by $R^{20}$ are an alkyl group; and wherein each $R^{21}$ is independently a hydrogen atom or a hydrocarbyl group having from 1 to 17 carbon atoms.

26. The lubricant composition of claim 14 further comprising an anti-wear additive.

27. The lubricant composition of claim 14 having a fluoropolymer seal compatibility such that a fluoropolymer seal submerged in said lubricant composition exhibits a change in elongation of from −60 to 10% or a change in tensile strength of from −50 to 10%, when tested according to CEC L-39-T96.

28. A method of lubricating a system comprising a fluoropolymer seal, said method comprising:

providing a lubricant composition that comprises a base oil, an iodide seal compatibility additive comprising at least one iodine atom, and a second seal compatibility additive, different from the iodide seal compatibility additive, wherein the weight of the second seal compatibility additive in the additive package is greater than or equal to the weight of the iodide seal compatibility additive in the lubricant composition, wherein said iodide seal compatibility additive comprises:

(1) an acyclic hydrocarbon backbone comprising at least one carbon atom, and wherein said at least one iodine atom is bonded to said at least one carbon atom in said acyclic hydrocarbon backbone and wherein said acyclic hydrocarbon backbone includes at least one hydroxyl group; or (2) an alkyl iodide compound having a general formula:

$$C_nH_{(2n+2-m)}I_m$$

where $n \geq 1$, and $1 \leq m \leq (2n+2)$; and contacting the fluoropolymer seal with the lubricant composition.

* * * * *